United States Patent [19]

Tsatskin

[11] Patent Number: 4,842,275

[45] Date of Patent: Jun. 27, 1989

[54] METHOD FOR CONDUCTING A COMPETITION

[76] Inventor: Yury Tsatskin, 1083 Brighton Beach Ave., Brooklyn, N.Y. 11235

[21] Appl. No.: 184,259

[22] Filed: Apr. 21, 1988

[51] Int. Cl.[4] ..... A63B 71/00

[52] U.S. Cl. ..... 273/1 R

[58] Field of Search ..... 273/1 R, 1 G, 1 GC, 273/1 E, 1 ES, 411, 25, 29 R, 32 R, 37, 55 R, 56, 108, 118, 126 R; 340/323 R

[56] References Cited

U.S. PATENT DOCUMENTS 3,943,505 3/1976 Berzin et al. ..... 273/1 ES X

*Primary Examiner*—Paul E. Shapiro

*Attorney, Agent, or Firm*—Bryan, Cave, McPheeters & McRoberts

[57] ABSTRACT

A method for conducting an interesting, competitive and equitable competition is described. The method may be programmed using known computer languages. The method provides an opportunity for second place finishers in early competition rounds to compete in an additional tournament, provided the first place finisher in that round qualifies for the final round of competition. The method also provides for the outcomes of the lower stage competitions to be used in both zone championships (e.g., regional or continental championships) and world championships. A unique scoring system is employed for soccer competitions to more accurately rank the relative performance of competitors.

12 Claims, 34 Drawing Sheets

| | NUMBER OF GROUPS IN ZONES | PLACES IN FINAL OF WINNERS OF GROUPS ON INTERMEDIATE STAGE | PLACES IN ADDITIONAL TOURNAMENT | |
|---|---|---|---|---|
| | | | FOR SECOND PLACE FINISHERS IN GROUPS ON INTERMEDIATE STAGE | FOR SECOND PLACE FINISHERS IN GROUPS WHERE FINALISTS PLAYED ON LOWER STAGE |
| GAMES | 4 | FROM 1 TO 4 | FROM 1 TO 4 OR FROM 5 TO 8 | FROM 5 TO 8 OR FROM 1 TO 4 |
| GAMES | 8 | FROM 1 TO 4 OR FROM 6 TO 9 | FROM 9 TO 12 OR FROM 13 TO 16 | FROM 13 TO 16 OR FROM 9 TO 12 |
| GAMES | 8 | FROM 1 TO 4 OR FROM 6 TO 9 | FROM 1 TO 4 OR FROM 5 TO 8 | FROM 5 TO 8 OR FROM 1 TO 4 |
| NON-GAMES | 4 | FROM 1 TO 4 | FROM 1 TO 8 | |
| NON-GAMES | 8 | FROM 1 TO 8 | FROM 1 TO 8 OR FROM 9 TO 16 | |

FIG. 1

<table>
<tr><th colspan="2">MATCHES OF ALL PRETENDERS IN GROUP (SUBGROUP)</th><th colspan="2">MATCHES OF PRETENDERS WITH EQUAL INDICES IN GROUP (SUBGROUP)</th><th rowspan="2">SCORING OF PLACES DEPENDING ON</th></tr>
<tr><th>POINTS</th><th>GOALS</th><th>POINTS</th><th>GOALS</th></tr>
<tr><td>NON-EQUAL</td><td colspan="3"></td><td>POINTS</td></tr>
<tr><td rowspan="4">EQUAL</td><td>NON-EQUAL</td><td colspan="2"></td><td>GOALS</td></tr>
<tr><td rowspan="3">EQUAL</td><td>NON-EQUAL</td><td></td><td>POINTS</td></tr>
<tr><td rowspan="2">EQUAL</td><td>NON-EQUAL</td><td>GOALS</td></tr>
<tr><td>EQUAL</td><td>LOT</td></tr>
</table>

PAIRED COMPETITION

FINAL OF ZONE CHAMPIONSHIP

| | PRETENDERS | 1 | 2 | 3 | 4 | G | PTS | PL |
|---|---|---|---|---|---|---|---|---|
| 1 | | X | | | | | | |
| 2 | | | X | | | | | |
| 3 | | | | X | | | | |
| 4 | | | | | X | | | |

| | PRETENDERS | 1 | 2 | 3 | 4 | G | PTS | PL |
|---|---|---|---|---|---|---|---|---|
| 1 | | X | | | | | | |
| 2 | | | X | | | | | |
| 3 | | | | X | | | | |
| 4 | | | | | X | | | |

FIG. 4

| | PRETENDERS | PTS | PL |
|---|---|---|---|
| 1 | | | |
| 2 | | | |
| 3 | | | |
| 4 | | | |
| 5 | | | |
| 6 | | | |
| 7 | | | |
| 8 | | | |

FIG. 5

| | PRETENDERS | PTS | PL |
|---|---|---|---|
| 1 | | | |
| 2 | | | |
| 3 | | | |
| 4 | | | |

FIG. 12

| | NUMBER OF GROUPS IN ZONES | PLACES IN FINAL OF WINNERS OF GROUPS ON INTERMEDIATE STAGE | PLACES IN ADDITIONAL TOURNAMENT | |
|---|---|---|---|---|
| | | | FOR SECOND PLACE FINISHERS IN GROUPS ON INTERMEDIATE STAGE | FOR SECOND PLACE FINISHERS IN GROUPS WHERE FINALISTS PLAYED ON LOWER STAGE |
| GAMES | 4 | FROM 1 TO 4 | FROM 1 TO 4 OR FROM 5 TO 8 | FROM 5 TO 8 OR FROM 1 TO 4 |
| GAMES | 8 | FROM 1 TO 4 OR FROM 6 TO 9 | FROM 9 TO 12 OR FROM 13 TO 16 | FROM 13 TO 16 OR FROM 9 TO 12 |
| GAMES | 8 | FROM 1 TO 4 OR FROM 6 TO 9 | FROM 1 TO 4 OR FROM 5 TO 8 | FROM 5 TO 8 OR FROM 1 TO 4 |
| NON-GAMES | 4 | FROM 1 TO 4 | FROM 1 TO 8 | |
| NON-GAMES | 8 | FROM 1 TO 8 | FROM 1 TO 8 OR FROM 9 TO 16 | |

METHOD FOR CONDUCTING A COMPETITION

BACKGROUND OF THE INVENTION

1. Field of the Invention

The present invention relates to a method for conducting a competition. More particularly, the present invention relates to a method for conducting a tournament which is more interesting, equitable and competitive.

2. Description of the Prior Art

It is well known to conduct competitions in a wide variety of activities. For example, it is common to conduct tournaments in athletic events such as tennis, basketball, soccer, wrestling, baseball, fencing, hockey, etc., and in such non-athletic events as beauty contests, quiz shows, spelling bees, etc. In many instances, tournament competitions are conducted at the conclusion of a full schedule of competitions. For example, the NCAA is well known for its post-season basketball tournament in which 64 teams are selected from all Division I basketball teams to compete for the national championship. Similarly, in professional basketball and hockey, teams qualify for post-season competition based upon their regular season performance.

In such prior art tournaments, it is common for competitors to be seeded based upon their prior performances. Thus, the competitor with the best record or best positional finish, e.g., first place, would be seeded first whereas the tournament-qualifying competitor with the worst record or positional finish would be seeded last. The seeding of tournament competitors determines the matched opponents in the first round of the tournament, and quite often for all succeeding rounds. Generally, in the first round of the tournament, the first seed is matched against the last seed, the second seed against the second-to-last seed, and so on, thereby giving the top seeded competitors a decided advantage.

In such prior art tournaments, early tournament rounds are generally non-competitive in that the competitors matched for play are of widely diverse ability. As a result, quite often there is little spectator interest in early tournament rounds. This low level of spectator interest translates to reduced attendance and therefore lower gate revenue. Moreover, television ratings are generally lower for early tournament rounds which typically translate to lower revenues to tournament organizers for broadcast rights.

Other prior art tournaments are conducted without seeding of competitors. In unseeded tournaments, there is a risk that the two best competitors will meet in the first round. The loser of this first round match is then generally excluded from further tournament participation, thereby depriving the tournament of one of its most competitive participants. The loss of a top competitor early in a tournament can also have a negative impact on spectator interest and tournament revenue at later stages of the tournament Moreover, the loss of a top competitor in the first round of an unseeded tournament, e.g., by losing to another top performer, prevents this losing competitor from pursuing a top finish in the tournament, e.g., as a silver or bronze medalist This result can be extremely unfair to tournament participants.

It is an object of the present invention to provide a method for conducting a tournament which is more interesting and competitive at all tournament levels It is a further object to provide a tournament method that is equitable to tournament competitors, and that is more likely to match the most-skilled competitors in the final tournament stage or stages, regardless of first round match-ups.

SUMMARY OF THE INVENTION

The present invention provides a method for conducting athletic or non-athletic competitions which involves:

(a) means for dividing competitors into a plurality of zones, wherein each zone comprises four or eight lower stage groups, and wherein each lower stage group comprises a plurality of competitors;

(b) means for collecting a first place finisher from one lower stage group in each of said zones to form an intermediate group, whereby the first place finishers in each of said lower stage groups are part of n intermediate group, and wherein the number of intermediate groups is equal to the number of lower stage groups;

(c) means for collecting all first place finishers from said intermediate groups to form one or two final groups of competitors, wherein the number of final groups is equal to one quarter the number of lower stage groups in each zone;

(d) means for collecting second place finishers from:

(i) each of the lower stage groups in which one of the final group competitors competed and (ii) each of the intermediate stage groups in which one of the final group competitors competed, to form one or two additional tournament groupings, each additional tournament grouping comprising eight competitors, wherein the number of additional tournament groupings is equal to one fourth the number of lower stage groups in each zone, and wherein the second place finishers from the lower stage group and from the intermediate stage group in which a final group competitor competed are separated so as to be matched against each other in said additional tournament grouping no earlier than the last round therein;

(e) means for adding the first place finisher from each of said one or two additional tournament groupings to a final group of competitors, such that each final group of competitors comprises five competitors; and (f) displaying the winner from said final group of competitors.

The present invention also provides for a competition for a regional championship, e.g., of a continent, to be combined with the competition described above. Thus, the invention provides means for collecting all of the first place finishers in a zone, i.e., the first place finishers from each of the lower stage groups in a zone, to form a final zone group. Thus, if a zone comprises four lower stage groups, the final zone group comprises four competitors, and if a zone comprises eight lower stage groups, the final zone group comprises eight competitors. In the latter case, the present method provides means for pairing the eight competitors within the final zone group to form four elimination round matches, and means for collecting the four winners from the elimination round matches to form a reduced final zone group of four competitors. The method then provides means for displaying the winner from the final zone group (in the case of four lower stage groups) or the reduced final zone group (in the case of eight lower stage groups).

In addition, the invention provides means for dividing six teams, each team comprising players from countries where the same language is the primary spoken language, into two groups, each group comprising three teams. The method then provides means for pairing the first place finishers from each group and means for pairing the second place finishers from each group, and means for displaying the final positions of the teams.

The method of the present invention thus displays the final positions of competitors from competitions that are more interesting and competitive, and that are more equitable to participating competitors.

BRIEF DESCRIPTION OF THE DRAWINGS

As used in the drawings herein, the term "pretender" is meant to describe a competitor in a competition of the present invention.

FIG. 1 is a schematic diagram of a preferred tie-breaking means for the competitions of the present method.

FIGS. 4 and 5 are score-tables for finals of zone championship competitions (non-sport games).

FIG. 12 is a schematic diagram showing the placement of competitors in an additional tournament and final.

DETAILED DESCRIPTION OF THE INVENTION

Figures 2, 3:
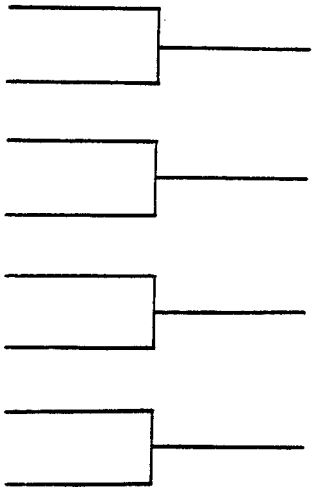
FIGS. 2 and 3 are score-tables for finals of zone championship competitions (sport games).

The method of the present invention may be used in conducting competitions that are athletic or non-athletic in nature, and in competitions in which the competitors are teams or individuals. For example, the present method may be employed for team athletic events such as basketball, soccer, baseball, hockey, etc., and for individual athletic events such as tennis, wrestling, fencing, gymnastics, and the like. Examples of team non-athletic events include quiz shows, academic competitions, e.g., math team meets, etc. Examples of individual non-athletic competitions include beauty contests, spelling bees, and the like. The present method is particularly suitable for use in competitions which include competitors from various geographic regions, e.g., Europe, America, Africa, and Asia. In such instances, it is advantageous to use these geographic regions in defining the zones which are discussed below.

The present method may be used for competitions which involve almost any number of competitors. To avoid byes in the earliest stage of the competition, however, it is preferred to have at least 36 competitors. As will be apparent to one of ordinary skill, there is no upper limit to the number of competitors that may be included in the present method.

The present method provides means for dividing the competitors into a plurality of zones. The number of zones is not critical to the invention, but generally there are from 3 to 8 zones, and preferably there are 4 zones. The competitors may be divided into zones according to any criterion. For example, zones preferably comprise competitors who are from the same geographic region.

Within each zone, competitors are divided into four or eight lower stage groups. The division of competitors into lower stage groups may also be accomplished based on the geographic location of competitors with attention given to distributing competitors of different skill level into each lower stage group. The number of competitors within each group is also not critical. If the number of competitors assigned to each zone is roughly equal, it may be desirable to divide competitors into lower stage groups of relatively equal size. However, the present method does not require groupings to be any minimum or maximum size. Typical groupings contain at least three competitors.

Within a zone, it is also possible to collect competitors into two or three subgroups. Typically, each subgroup comprises four or five competitors. If competitors within a lower stage group are collected into two subgroups, the present method may be provided with means to match the first place finisher from the first subgroup against the first place finisher from the second subgroup. The winner of this match between first place finishers from the two subgroups is then the first place finisher for the lower stage group to which the subgroups belonged, and the loser is the second place finisher for the lower stage group.

If competitors within a lower stage group are collected into three subgroups, the present method may be provided with means to collect the first place finishers from each subgroup into a lower stage grouping. The first place finisher from this lower stage group would thus advance to an intermediate stage group and optionally a final zone group, e.g., for a continent championship, as described below.

In sporting game competitions, each of the competitors within a lower stage group competes twice against each other competitor in the lower stage group, one time at each of the competitor's home stadium or arena. In most other athletic non-game and non-athletic competitions, competitors generally compete in a single round-robin competition in a single location. In some athletic events, e.g., gymnastics, and some non-athletic events, e.g., quiz shows, all competitors typically compete in a single, all-inclusive competition.

The present method is typically provided with means to score the competition results. Conventional scoring systems may be employed, e.g., for soccer two points may be awarded a winner, one point each to tying competitors and zero points to a loser. However, in the case of soccer, a preferred means for scoring competitions involves awarding 2.5 points to a competitor who wins a match in regulation time, i.e., without entering an overtime period. If a match is tied at the end of regulation time, the number of points awarded to the overtime winner depends on the manner in which the winner is determined. Thus, if a winning goal is scored during an established sudden-death overtime period, e.g., 30 minutes, then the winner is awarded 1.5 points. However, if the overtime winner is established by some other means after the conclusion of the established overtime period, e.g., by penalty shots, then the winner is awarded 1.0 points. In any event, the losing competitor in each match is awarded zero points. This preferred scoring means more accurately reflects the degree to which the winning competitor outperformed the losing competitor in the match, and therefore will more accurately reflect the relative skill of a group of competitors.

After the conclusion of the lower stage competitions, the position of each competitor (with the exception of a lower stage group containing two subgroups, as described above), is determined in each lower stage group by the number of points awarded during the lower stage competitions. Thus, the competitor with the most points is the first place finisher, the competitor with the second highest point total is the second place finisher, etc.

In the event two or more competitors are tied for any position, tie-breaking means are employed. Although any tie-breaking means may be employed, a preferred tie-breaking means is shown in FIG. 1. As shown therein, the first criterion for determining a first or second place finisher is the total number of points. If two competitors have the same number of points, the first tie-breaker is the number of goals scored. If both competitors scored the same number of goals in lower stage group competitions, the second tie-breaker is the number of points earned by each of the tied competitors in head-to-head competitions against competitors having equal total points. If the tied competitors each earned an equal number of points in head-to-head competition, the next tie-breaker is the number of goals scored between tied competitors in head-to-head competition. If this tie-breaker also fails to break a tie, the final tie-breaker is by lot, e.g., by flipping a coin.

According to the present method, the first place finishers from each of the lower stage groups within a zone may compete for a zone championship (regional or continental championship). In the case of sporting game competitions, if there are eight lower stage groups in each zone as shown in FIG. 2, the present method provides means for randomly dividing the eight first place finishers from the lower stage groups into four pairs. Each of the paired competitors compete twice, once at the home field or arena of each competitor. The winner from each of these pairs is determined by the means shown in FIG. 1. The winners from each of the pairs are collected into a zone championship group (regional or continental championship). Thus, the zone championship comprises four competitors. If the zone contained only four lower stage groups, as shown in FIG. 3, the first place finishers from each of these lower stage groups advance directly to the zone championship group.

The competitors in the zone championship group compete in a single round-robin tournament. The positions of the competitors are determined according to the criteria shown in FIG. 1. Otherwise, as shown in FIG. 4 (eight groups) and FIG. 5 (four groups), all the first place finishers are collected directly in a final of the zone championship. These competitors compete in a single round-robin competition and their final positions are determined by the criteria shown in FIG. 1.

The present method also provides means for displaying the final positions of the competitors in the zone championship group. The present method thus allows for the combination of regional tournaments, e.g., continental championships, with tournaments of larger scope, e.g., world championships, by utilizing the same lower stage group competitions in both tournaments, i.e., using the same eliminatory competitions.

The present method also provides means for collecting a first place finisher from one lower stage group from each zone to form an intermediate group. The number of competitors in each intermediate group is equal to the number of zones, with one competitor in each intermediate group being drawn from each zone. The number of intermediate groups formed according to the present method depends on the number of lower stage groups in each zone. If there are four lower stage groups in each zone, then four intermediate groups are formed. However, if eight lower stage groups are included in each zone, then eight intermediate groups are formed. The first place finishers of lower stage groups are typically formed into intermediate groups in a random fashion.

According to the present invention, means for collecting first place finishers from the intermediate groups into one or more final groups is provided. If there are four lower stage groups within each zone and therefore four intermediate groups, then a single final group is formed that comprises the four intermediate stage first place finishers and, as described below, an additional tournament winner. However, if each zone contains eight lower stage groups and therefore eight intermediate stage groups are formed, then two final groups are formed in a random fashion, each final group containing four intermediate group first place finishers and one additional tournament winner, as described below.

The present method further provides means for collecting second place finishers from:

(a) each of the lower stage groups in which one of the final group competitors competed; and (b) each of the intermediate stage groups in which one of the final group competitors competed; to form one or two additional tournament groupings. The number of additional tournament groupings is equal to one fourth the number of lower stage groups in each zone. Thus, if there are eight lower stage groups in each zone, then two additional tournament groupings are formed. Each additional tournament grouping contains eight competitors.

The second place finishers are collected into additional tournament groupings such that two second place finishing competitors, one from a lower stage group and one from an intermediate stage group, who competed in groups containing the same final group competitor would be matched no earlier than the final round of the additional tournament. By way of illustration, if Competitor A was the first place finisher both in Lower Stage Group 1 and in Intermediate Group 3, and is therefore a final group competitor, then the second place finishers in Lower Stage Group 1 and Intermediate Group 3 are collected into an additional tournament grouping. If there is more than one additional tournament grouping, it is determined randomly whether these two second place finishers are grouped in the same additional tournament grouping. However, in the event that they are grouped in the same additional tournament grouping, and if the additional tournament is conducted such that teams are eliminated from further tournament competition based on match outcomes, e.g., a single elimination tournament based on two competitions (one competition at the home field of each competitor), then these two competitors are positioned within the additional tournament grouping such that they meet in head-to-head competition no earlier than the last round. The placement of competitors in the additional tournaments is described in greater detail below with reference to FIGS. 7–12.

The competitors within the additional tournament grouping compete in a single elimination tournament, but each elimination round is based on two competitions, one at the home field of each competitor. The collection of competitors in additional tournament groupings gives these competitors a fresh opportunity to get over an "unlucky fate" and to advance to the final group of competitors.

The preset method provides means for adding the first place finisher or finishers from the additional tournament grouping or groupings to the final group or groups of competitors. Therefore, as set forth above, each final group contains a total of five competitors which comprise four first place finishers from intermediate groups and one first place finisher from an additional tournament group. If there is more than one final group then the first place finisher from an additional tournament grouping is placed in the final group which does not contain the first place finisher from its lower group stage or intermediate group.

The competitors in each final group compete in a single round-robin competition. If there are two final groups, the top three finishers in the first final group based on points and, if necessary, tie-breaking criteria, compete once against each of the top three finishers in the second final group. Thus, each of the top three finishers in each of the two final groups participates in seven matches, i.e., four matches as part of the single round-robin tournament and three additional matches against the top three finishers in the other final group.

The competitor having the most points or the best tie-breaking position is the winner of the competition. The second place finisher and third place finisher are determined in the same way. Additional tournament formats for use in establishing a winner from the final group or groups of competitors will be apparent to those of ordinary skill in the art.

The present method displays the winning competitor, e.g., by lighting or flashing the winning competitor's name on an electronic scoreboard or other suitable displaying means. The final positions of other final group competitors, e.g., second and third place finishers overall, may also be displayed according to the present method.

Figure 6:
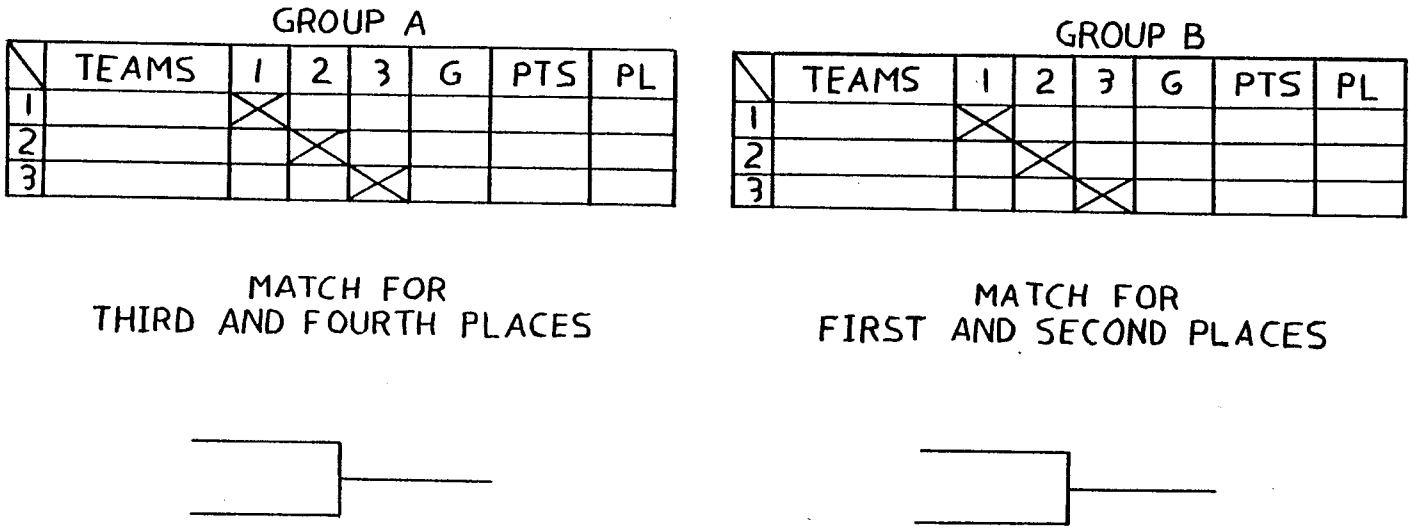
FIG. 6 is a score-table for an international soccer competition (Lingua Cup) of the present invention.

The present method also provides means for randomly dividing six teams, each team comprising players from countries where the same language is the primary spoken language, into two groups as shown in FIG. 6. For example, the team may comprise players who speak English, German, Italian, French, Portuguese or Spanish. The teams within each group compete in a single round-robin tournament and the first, second and third place finishers in each group are determined by the criteria shown in FIG. 1. The present method then provides means for pairing the first place finishers and the second place finishers from each group, as also shown in FIG. 6. The paired first place finishers compete in a single match to determine the overall first place (winner) and second place (loser) finishers. The paired second place finishers also compete in a single match to determine the overall third place (winner) and fourth place (loser) finishers. The method further provides means for displaying the final team positions, i.e., first to fourth place finishers, of the competition. This competition may be entitled a Lingua Cup.

The present method may be programmed using any computer language, e.g., BASIC, FORTRAN, COBOL, etc. for processing on a computer capable of operating a program written in the language selected, e.g., an IBM personal computer. The programming of the present method is well within the skill of one of ordinary skill in the art using known computer programming principles. The design of a suitable interface between the computer program and means for displaying the tournament winner is also well within the skill of one of ordinary skill in the art.

The present method is further illustrated by reference to the score-tables of FIGS. 7–11, each of these figures is broken into a series of component figures. Thus, FIG. 7 comprises FIGS. 7A–7H, FIG. 8 comprises FIGS. 8A–8H, FIG. 9 comprises FIGS. 9A–9D, FIG. 10 comprises FIGS. 10A–10F, and FIG. 11 comprises FIGS. 11A–11C.

FIG. 7 shows a score-table for a soccer competition which comprises three zones, a European zone, an American zone and an African-Asian zone. The European and American zones each comprise eight lower stage groups. As shown in FIG. 7A, European group 1 (EU-1) contains 4 competitors and European group 2 (EU-2) contains 5 competitors, while American group 1 (AM-1) contains 4 competitors and American group 2 (AM-2) contains 3 competitors. The remaining lower stage groups within the European and American zones are shown schematically in FIGS. 7A and 7C, i.e., only the top two competitors are shown in each group. However, it is to be understood that these lower stage groups each contain more than two competitors.

Figure 7A:
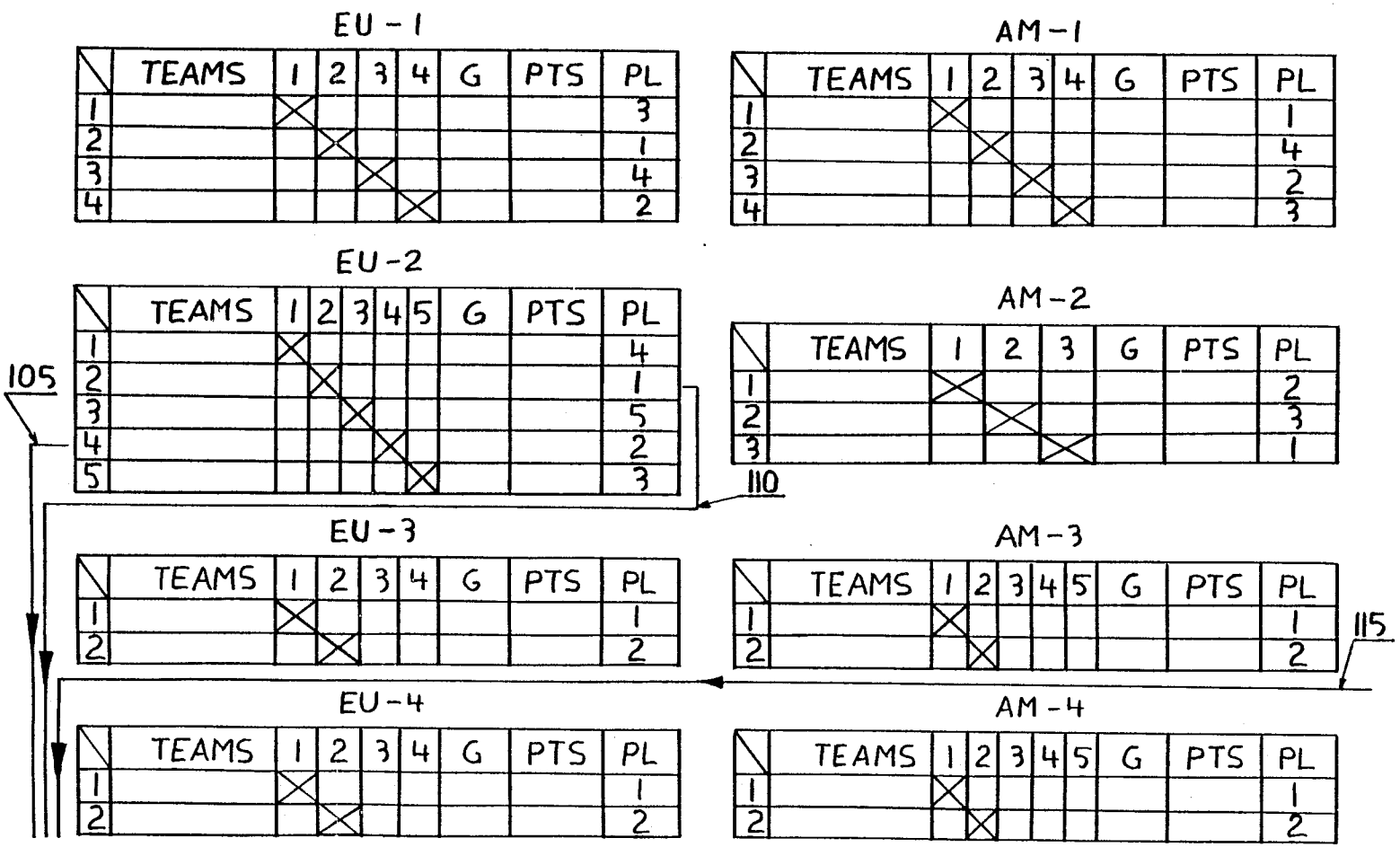
FIGS. 7A–7H, 8A–8H, 9A–9D, 10A–10F, and 11A–11C are score-tables showing various competitions of the present invention.

The first place finisher in each of these lower stage groups qualifies for an intermediate group. Each intermediate group is formed randomly. Thus, as shown in FIGS. 7A, 7C, and 7E, the first place finisher in lower stage group EU-2 advances to intermediate group E by lead line 110 and the first place finisher in group AM-6 advances to intermediate group E by lead line 120.

Figure 7B:
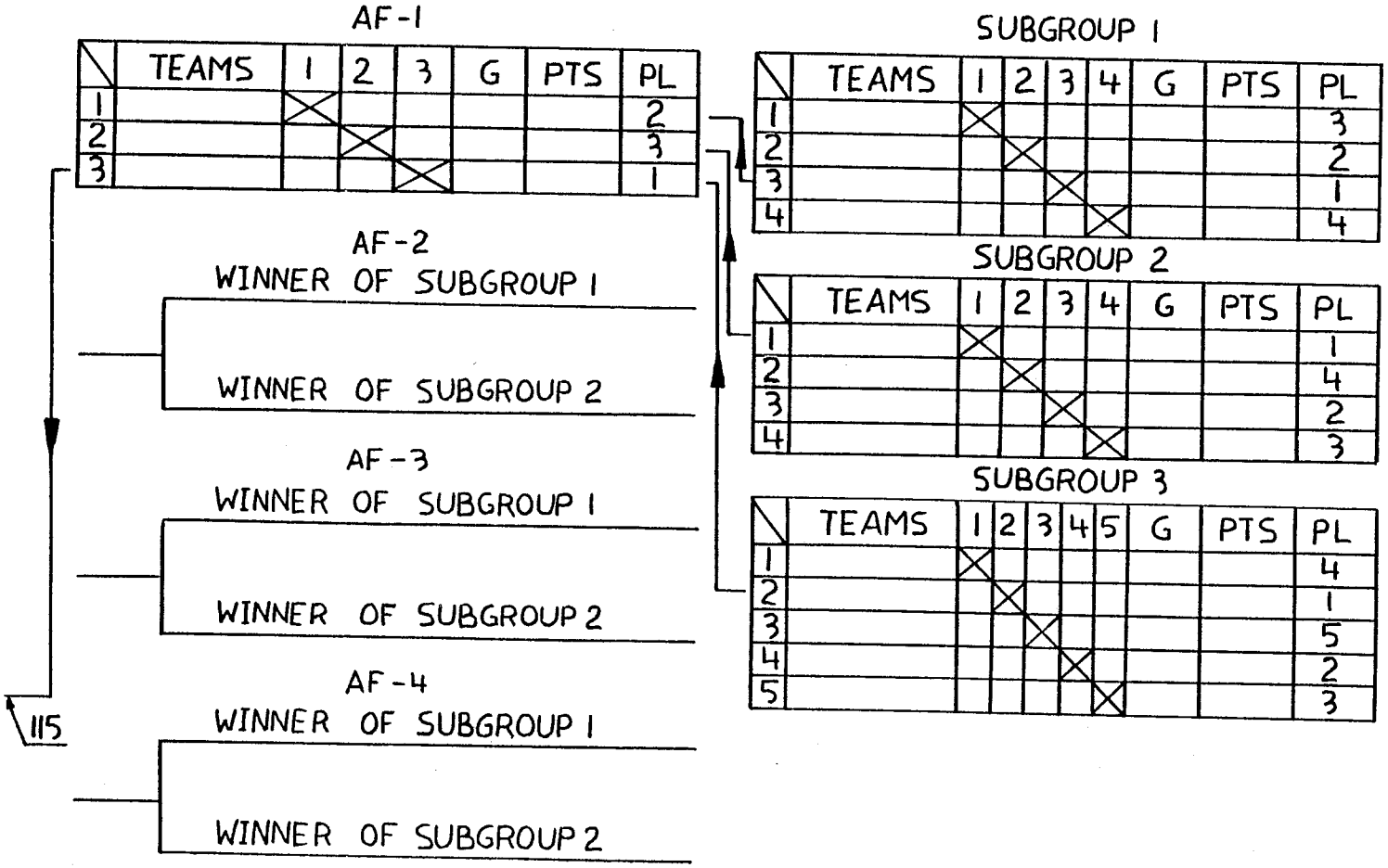
Figure 7C:
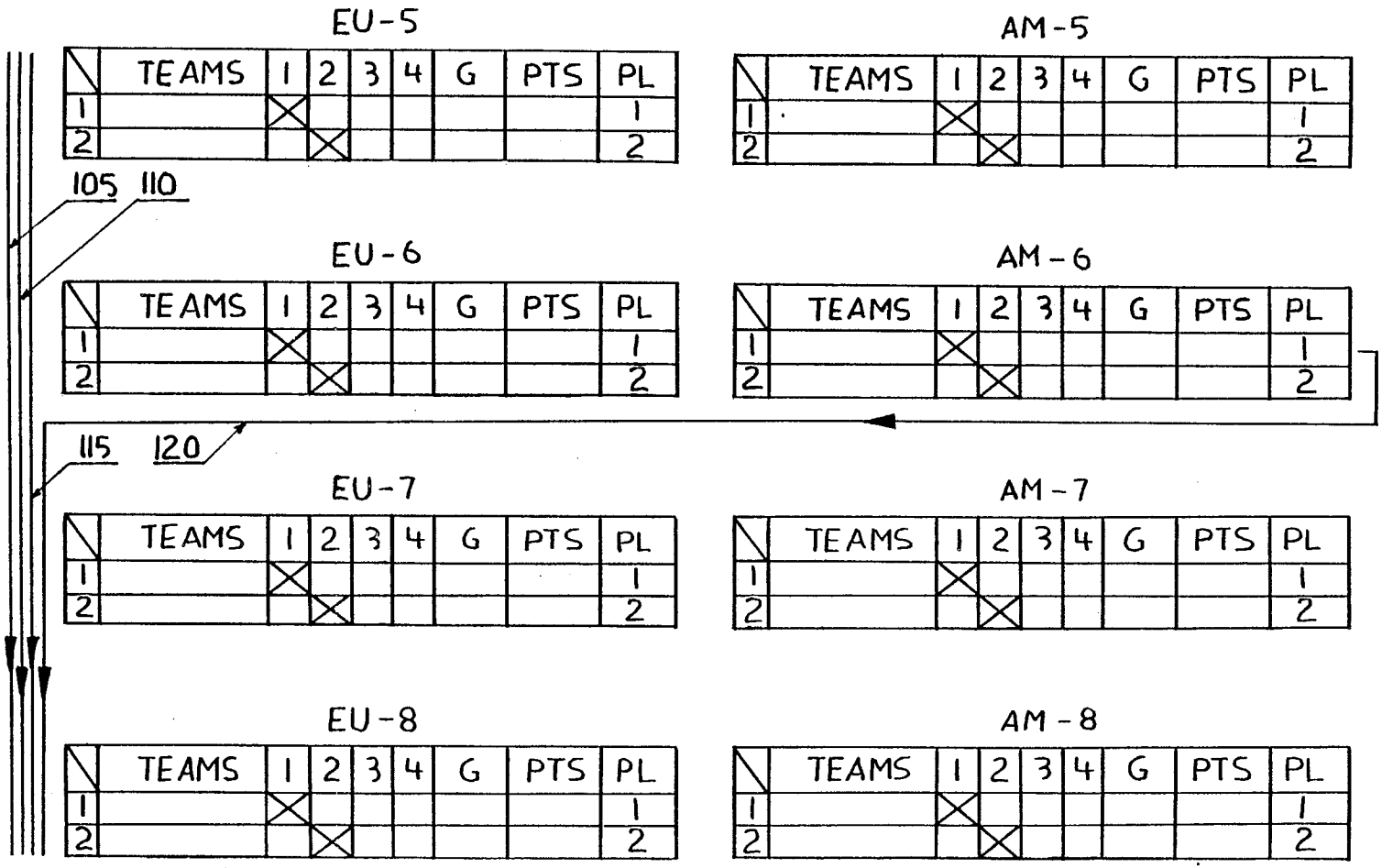
Figure 7D:
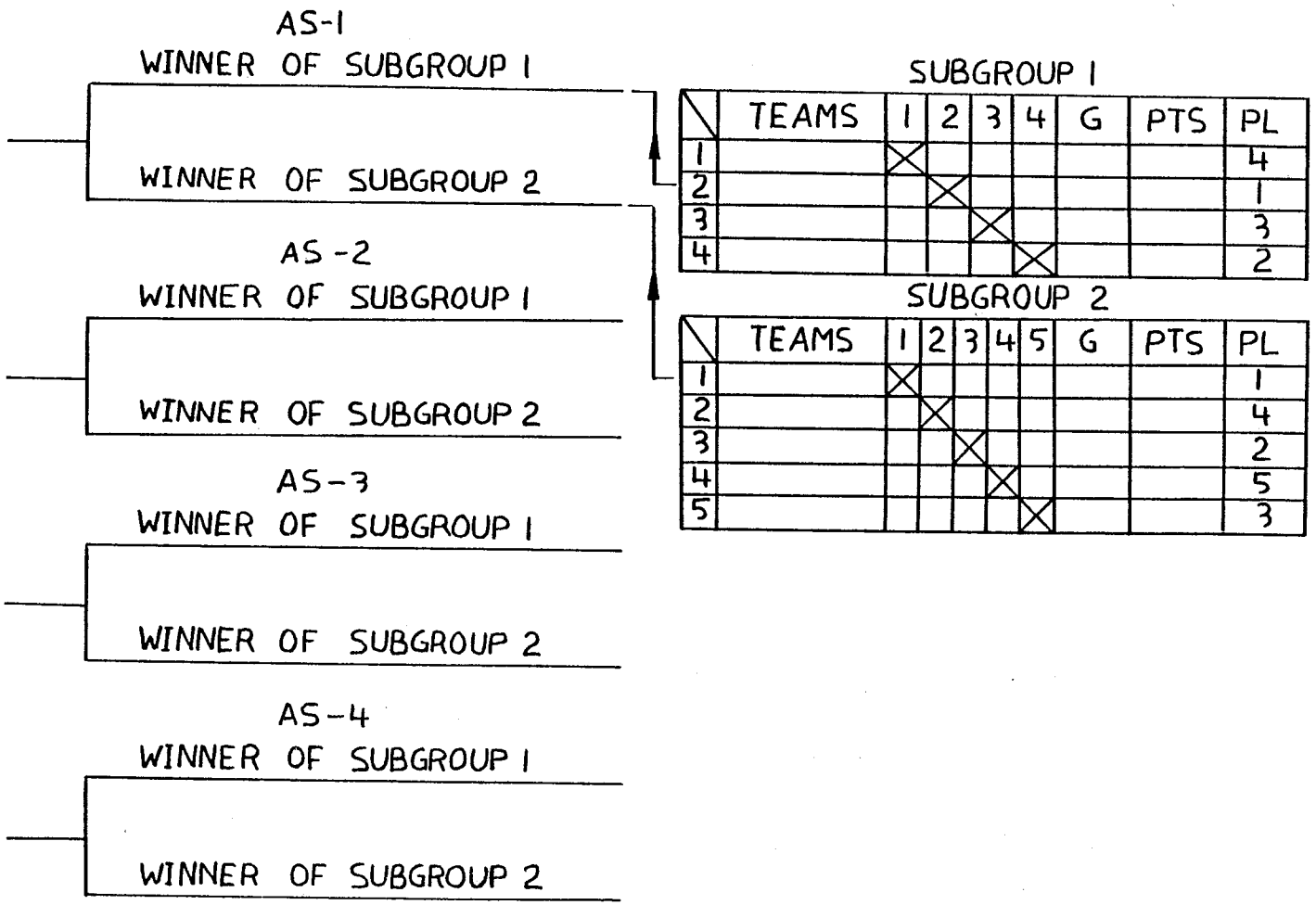

In the African-Asian zone, each lower stage group is broken into subgroups, as shown in FIGS. 7B and 7D. African group 1 (AF-1) is broken into 3 subgroups, subgroups 1 and 2 each containing 4 competitors and subgroup 3 containing 5 competitors. The remaining lower stage groups in this zone are each broken into two subgroups.

As shown in FIG. 7B, in each subgroup to lower stage group AF-1, after competitions on the home field of each competitor, the first place finisher qualifies for a three team lower stage group. The winner in this lower stage group advances to intermediate group E (FIG. 7E) as shown by lead line 115. However, in the remaining lower stage groups within the African-Asian zone, the first place finishers in the first subgroup advance to compete against the first place finisher in the second subgroup twice, once on the home field of each competitor. The winner in each of these head-to-head competitions advances to an intermediate group (none pictured).

Figure 7E:
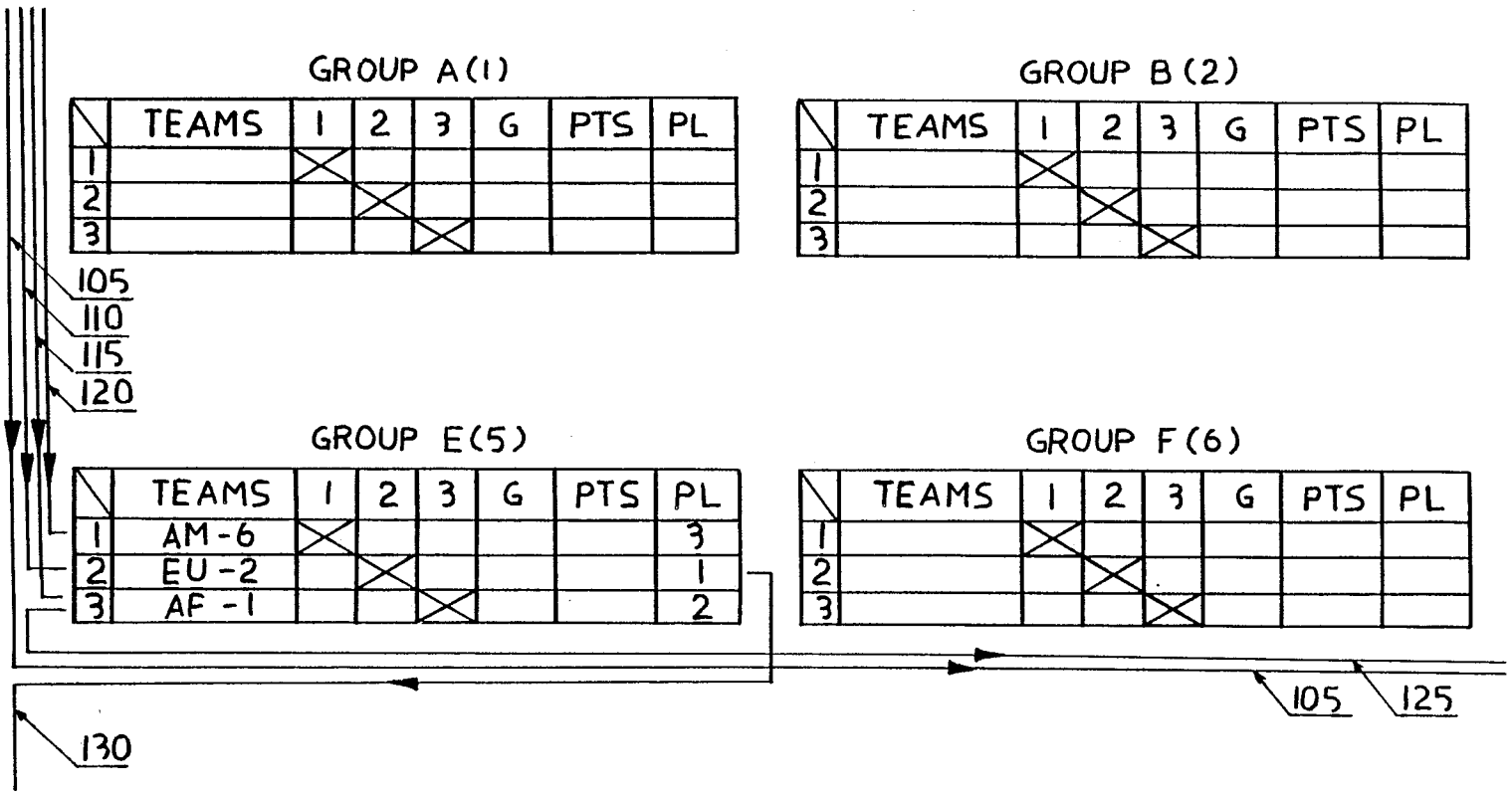
Figure 7F:
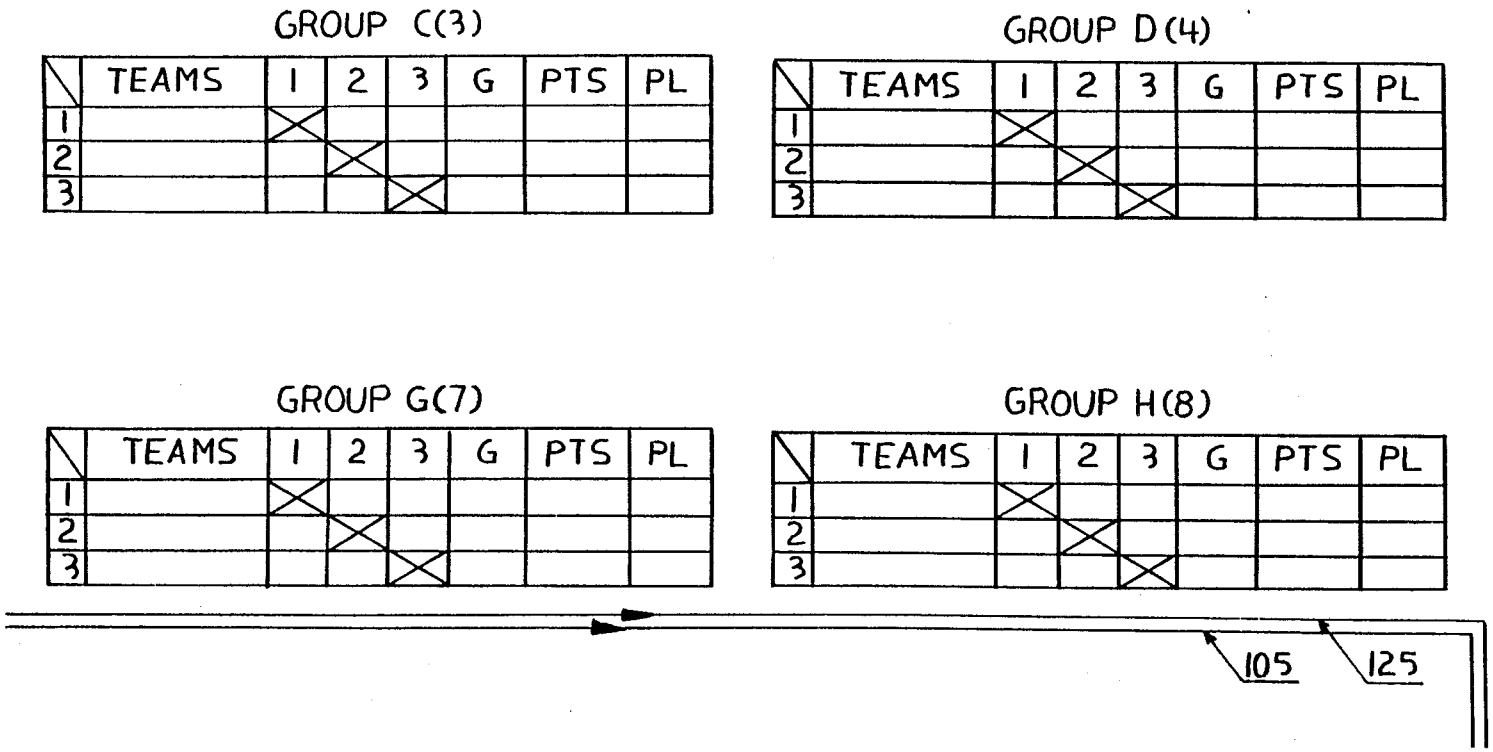
Figure 7G:
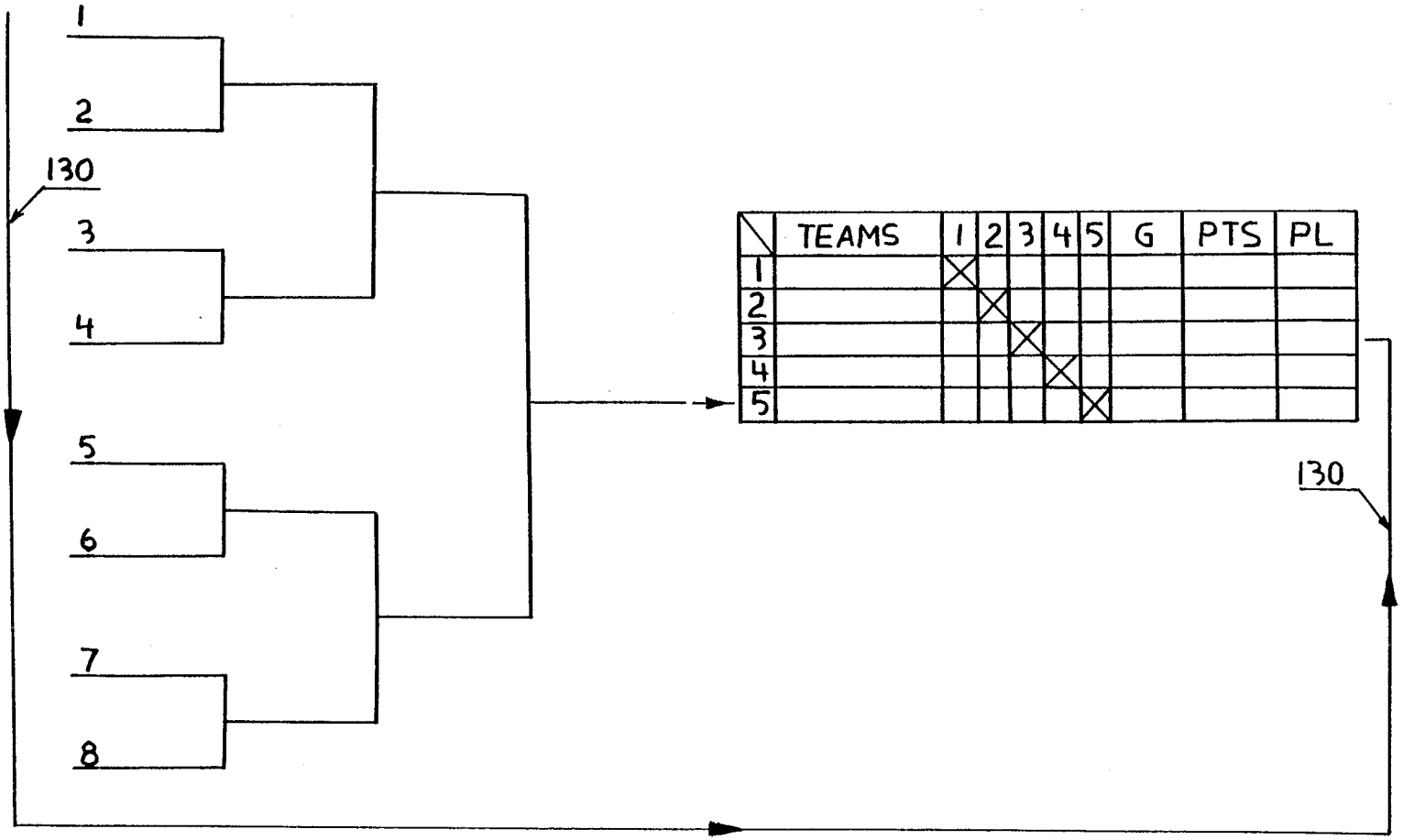

As shown in FIGS. 7E and 7G, the first place finisher in intermediate group E advances to final group A by lead line 130. This competitior originally competed in the European zone in lower stage group EU-2. Thus, the second place finisher in group EU-2 qualifies for an additional tournament, as does the second place finisher in intermediate group E. These competitors advance to Additional Tournament (Section II) in FIG. 7H, as shown by lead lines 105 and 125, respectively. These two competitors are positioned with the additional tournament such that they would not directly compete until the final stage of the additional tournament.

Figure 7H:
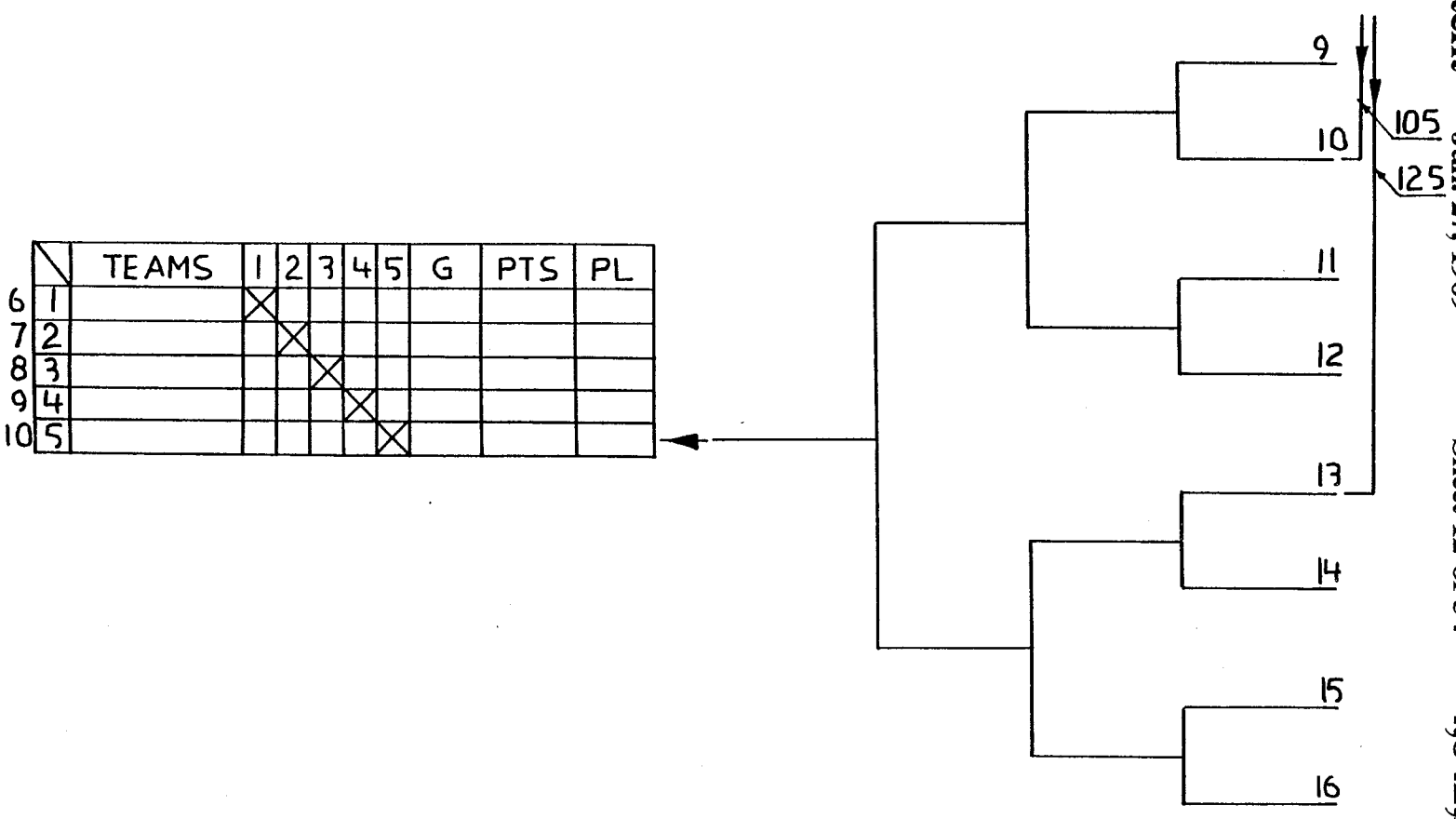
Figure 8A:
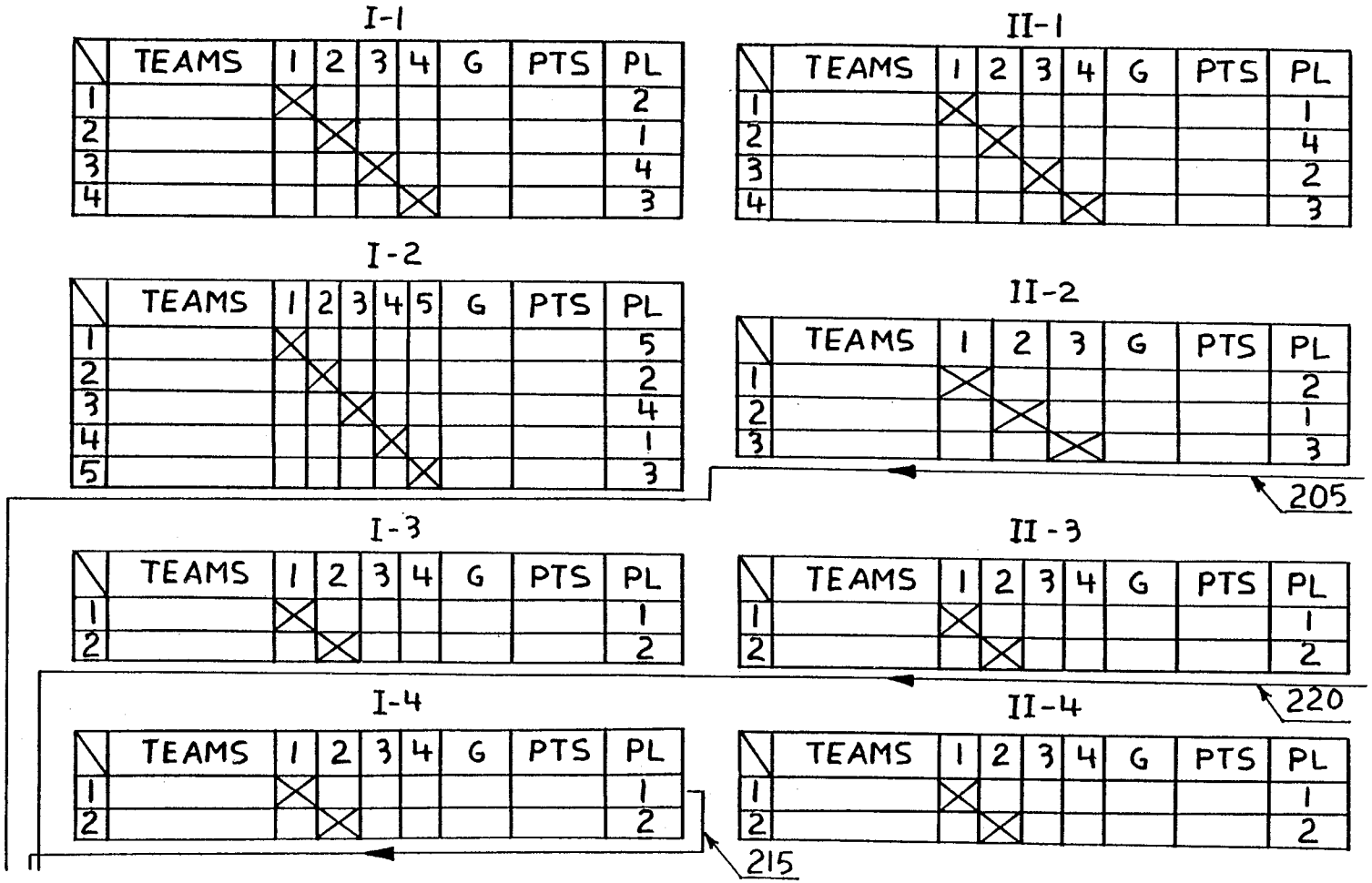
Figure 8B:
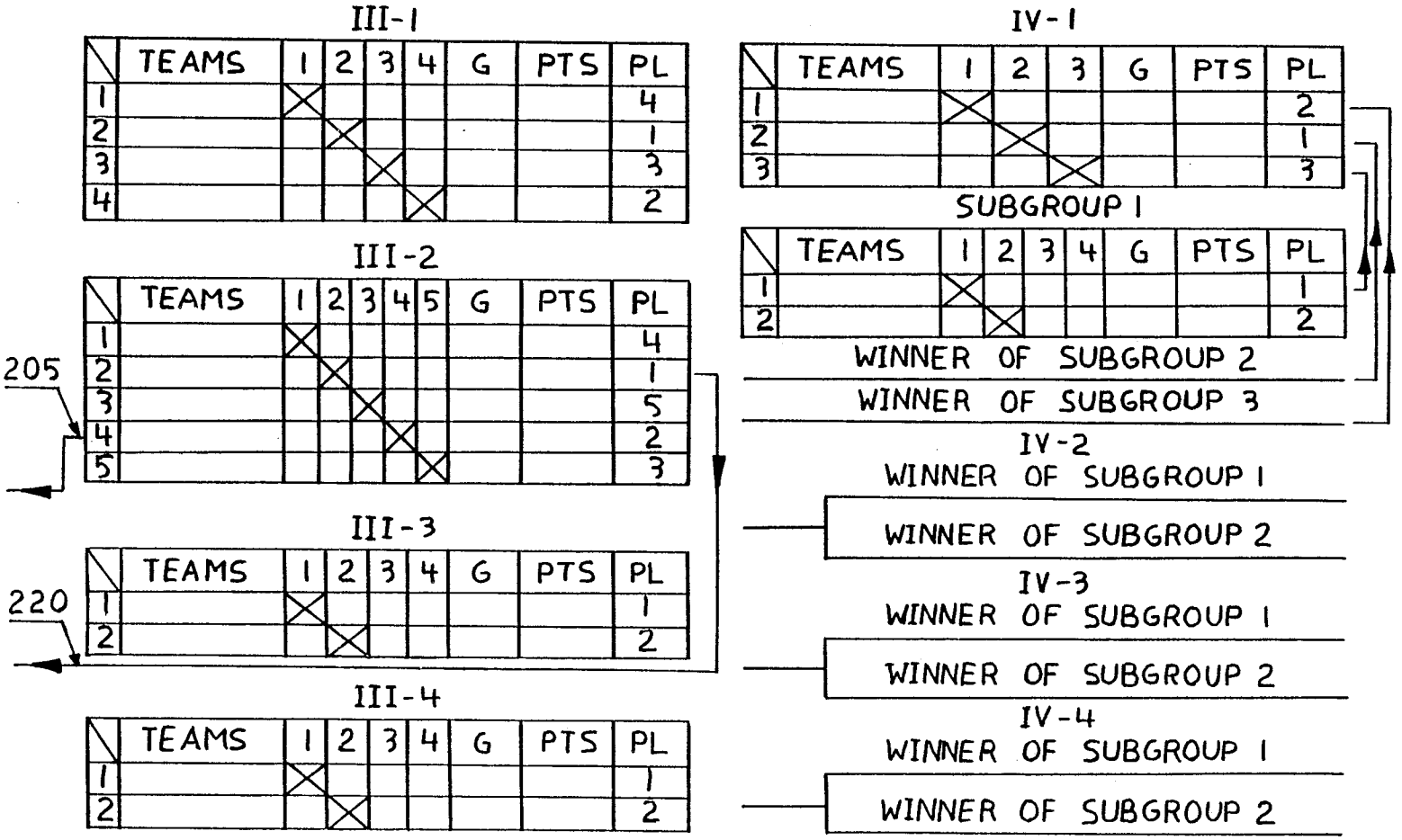
Figure 8C:
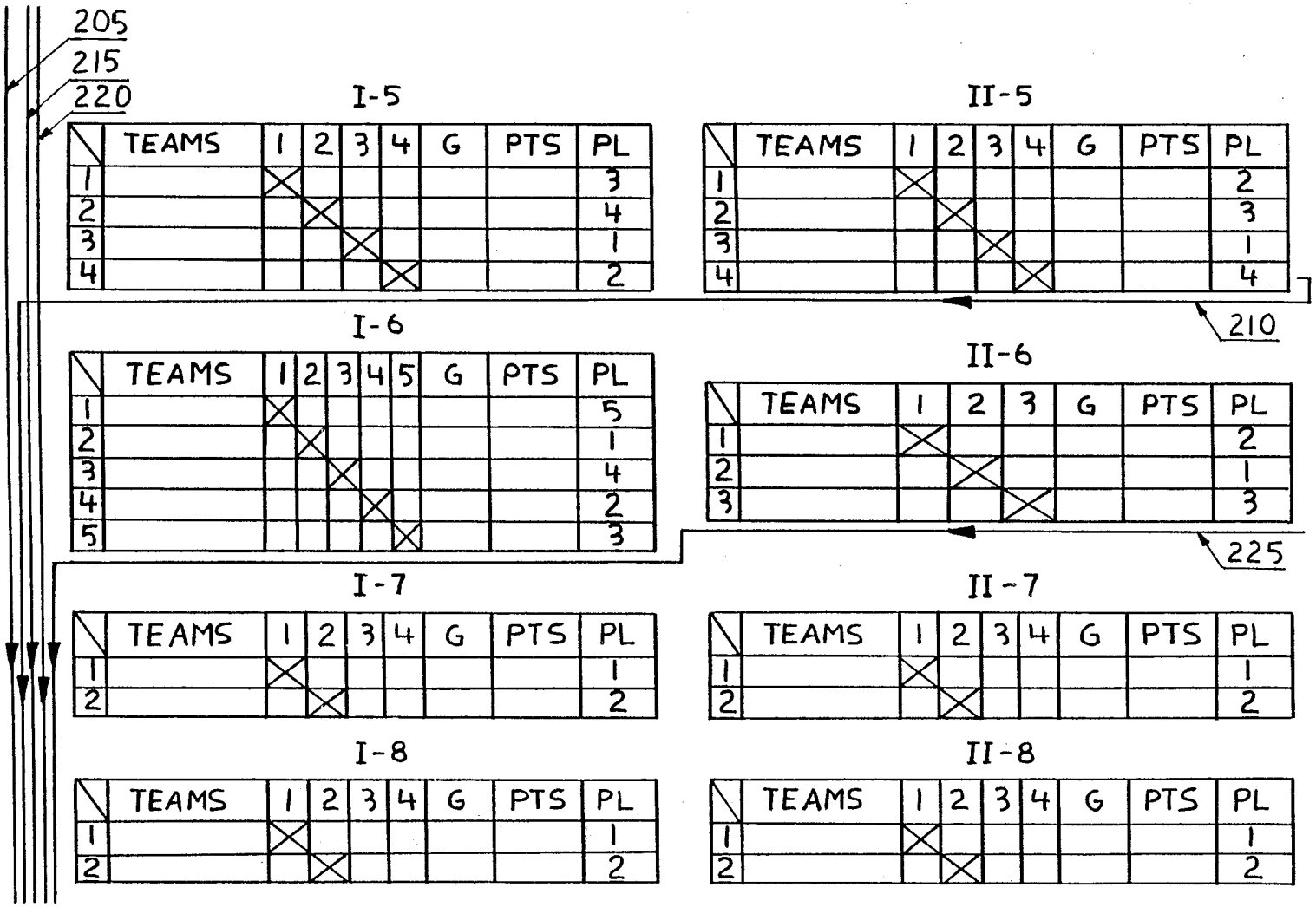
Figure 8D:
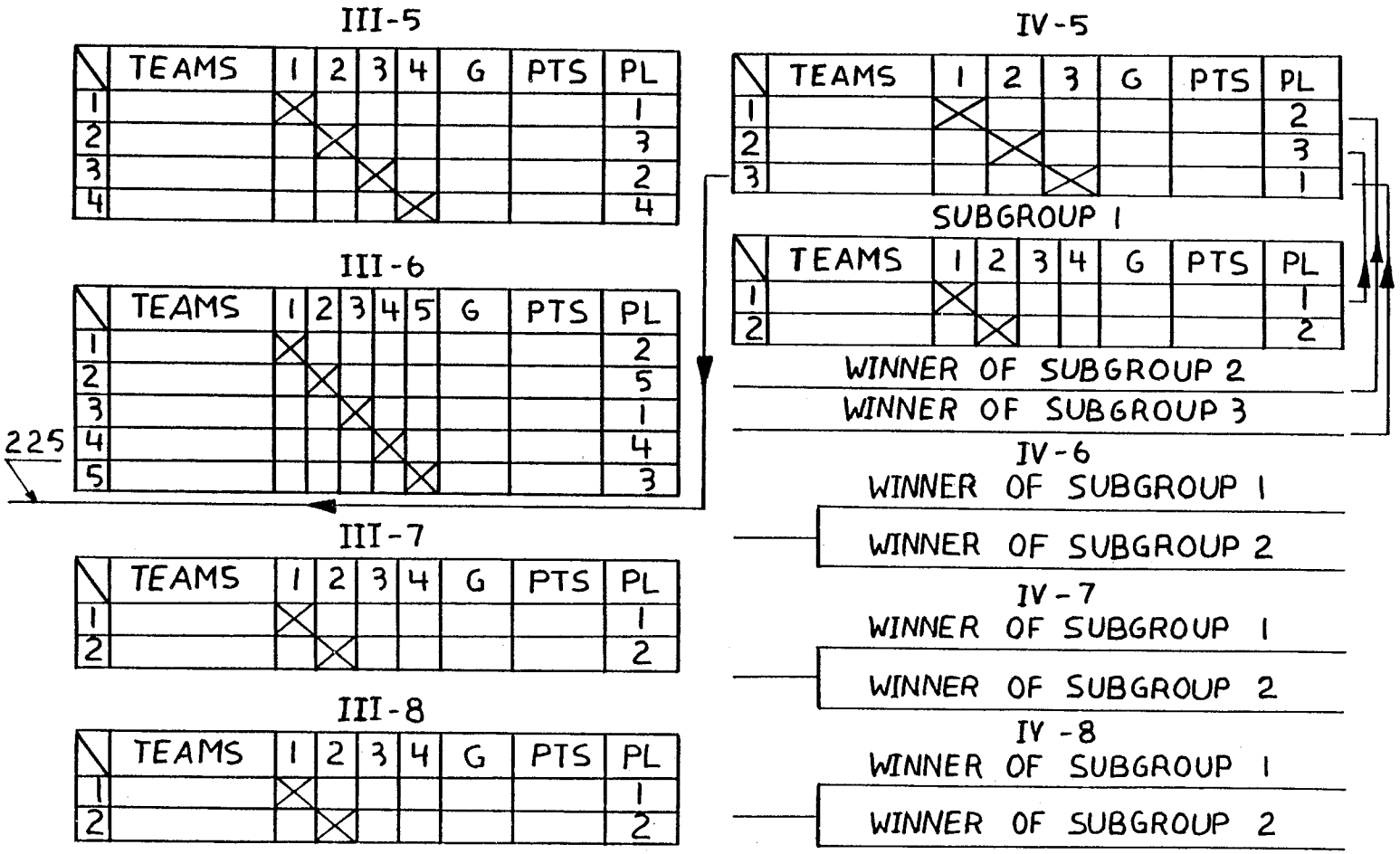
Figure 8E:
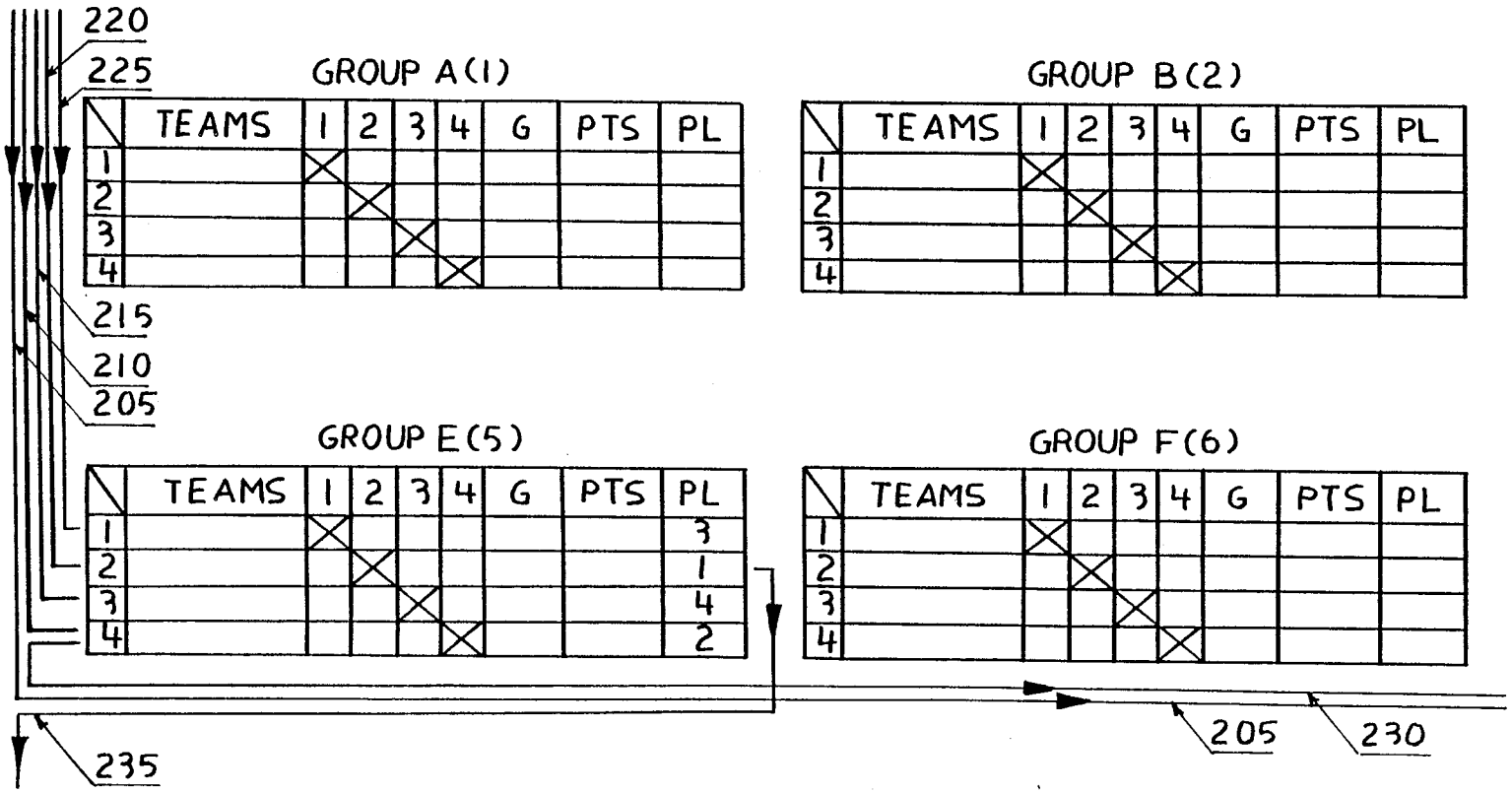
Figure 8F:
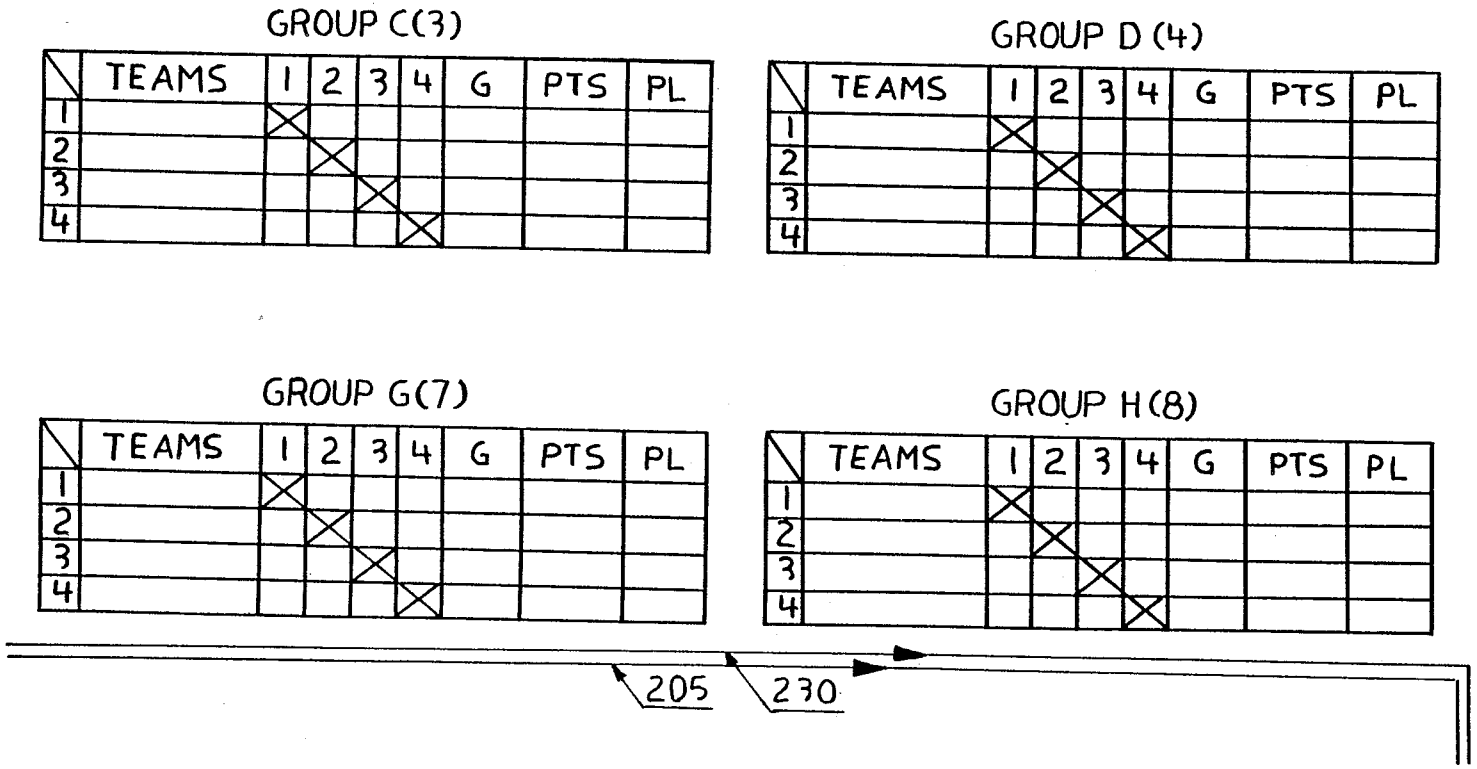
Figure 8G:
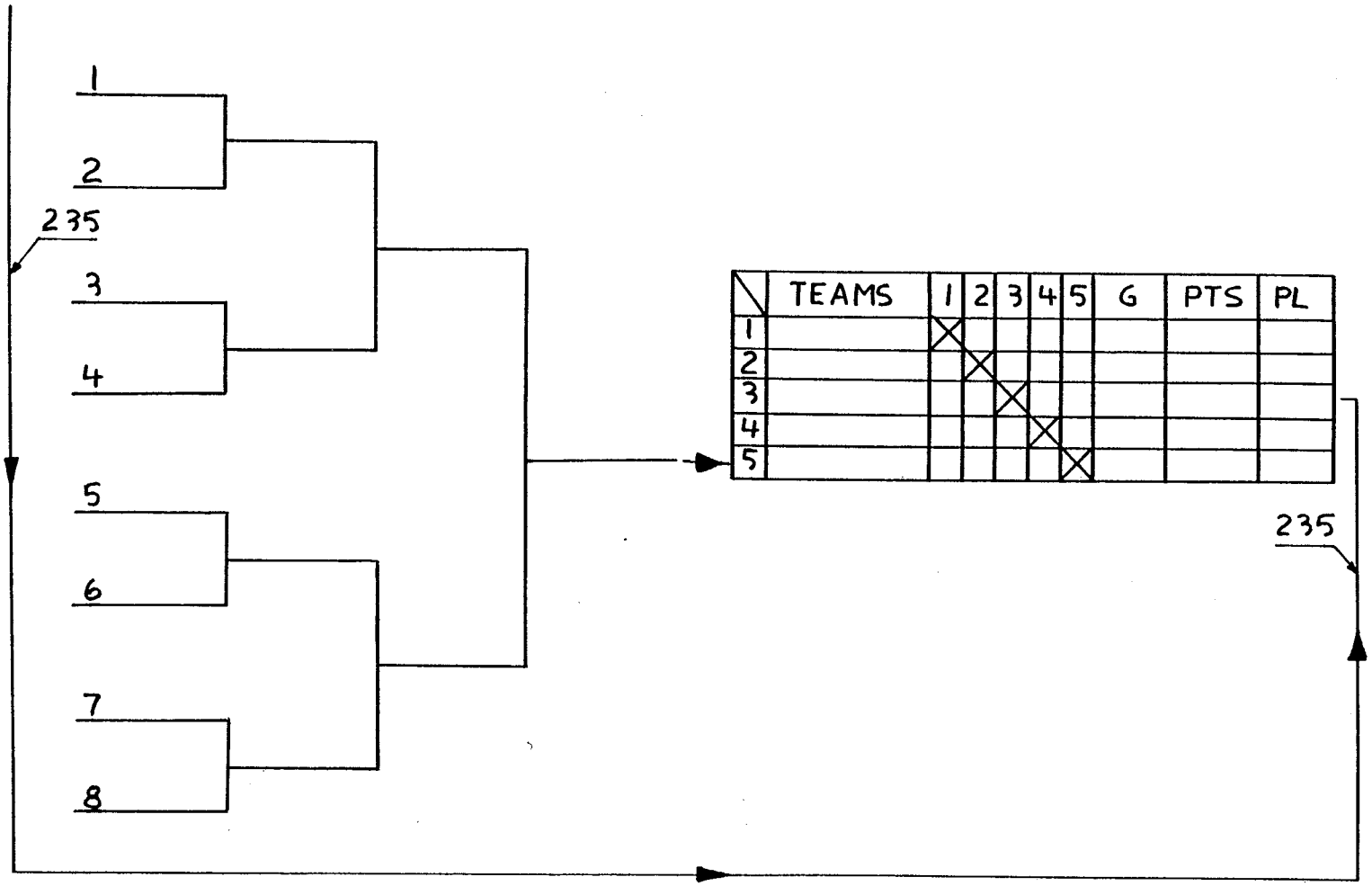
Figure 8H:
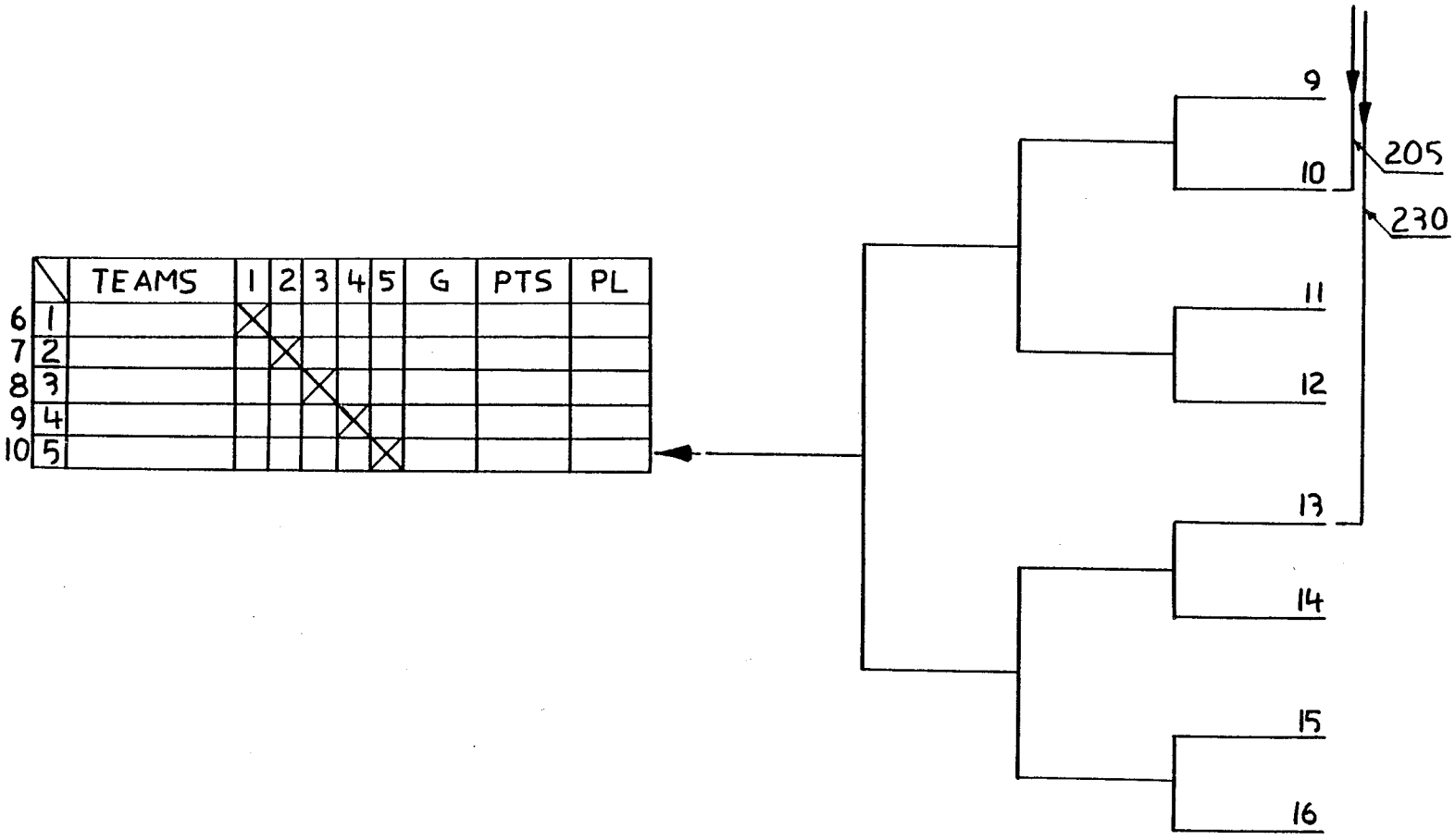
Figure 9A:
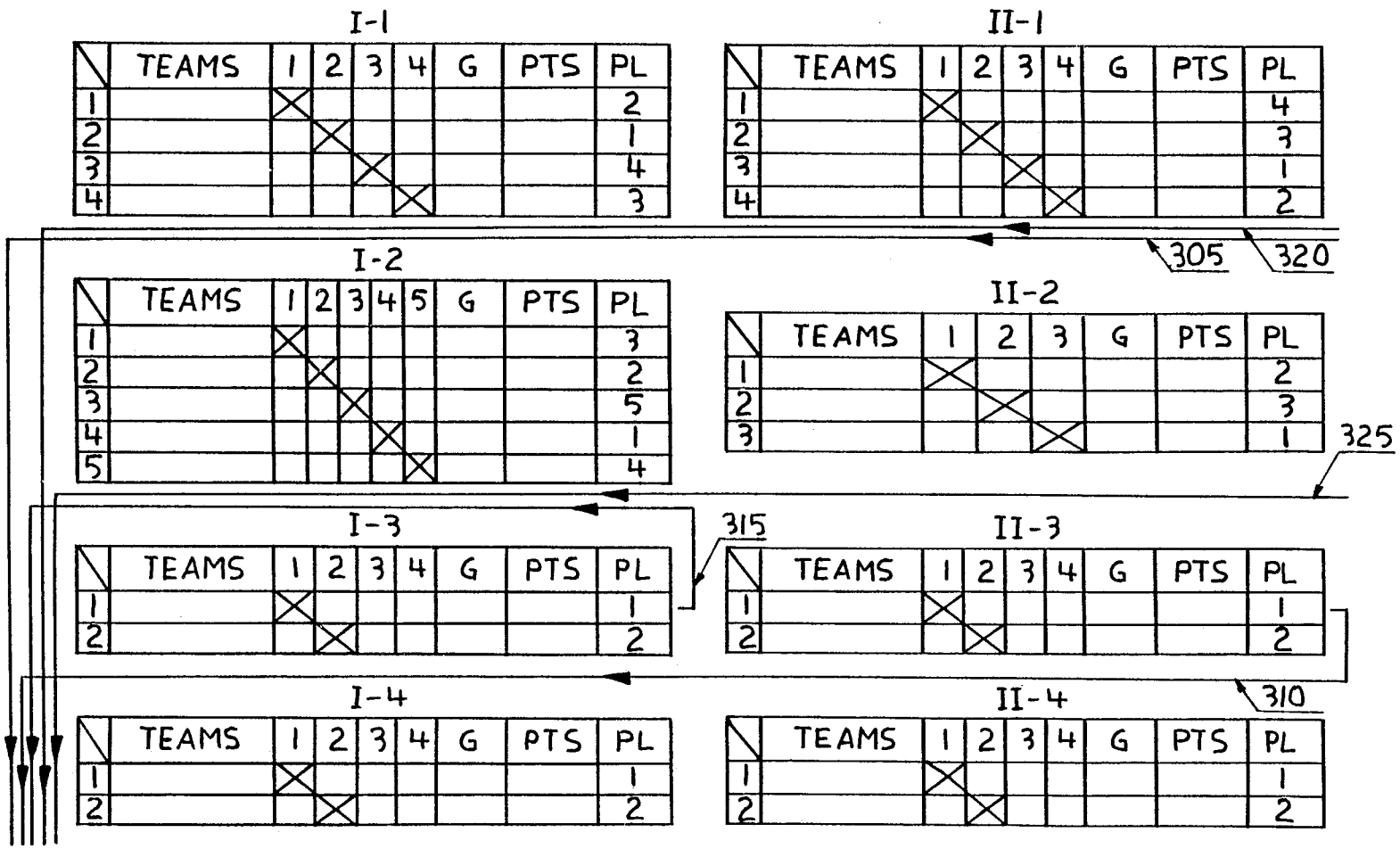
Figure 9B:
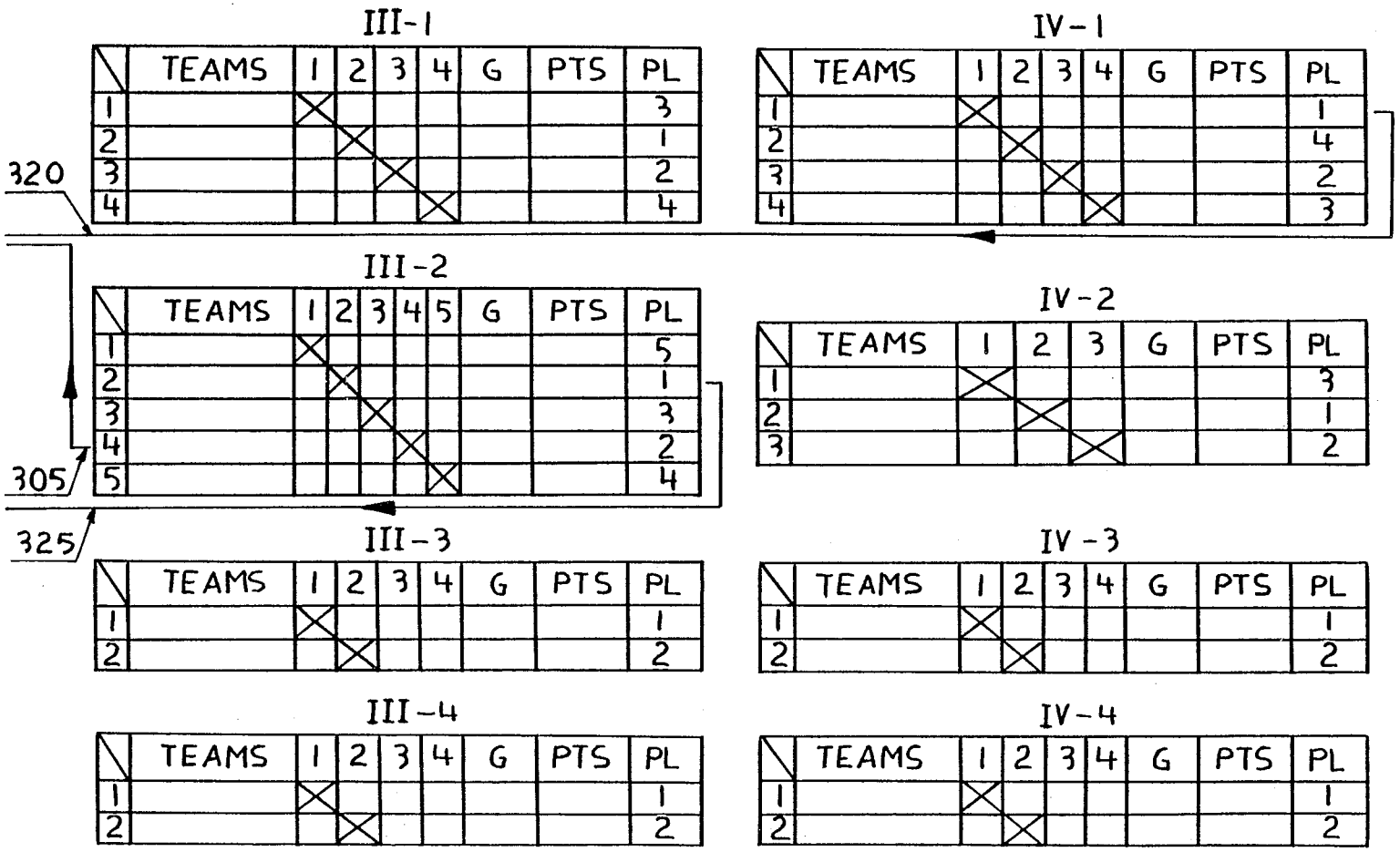
Figure 9C:
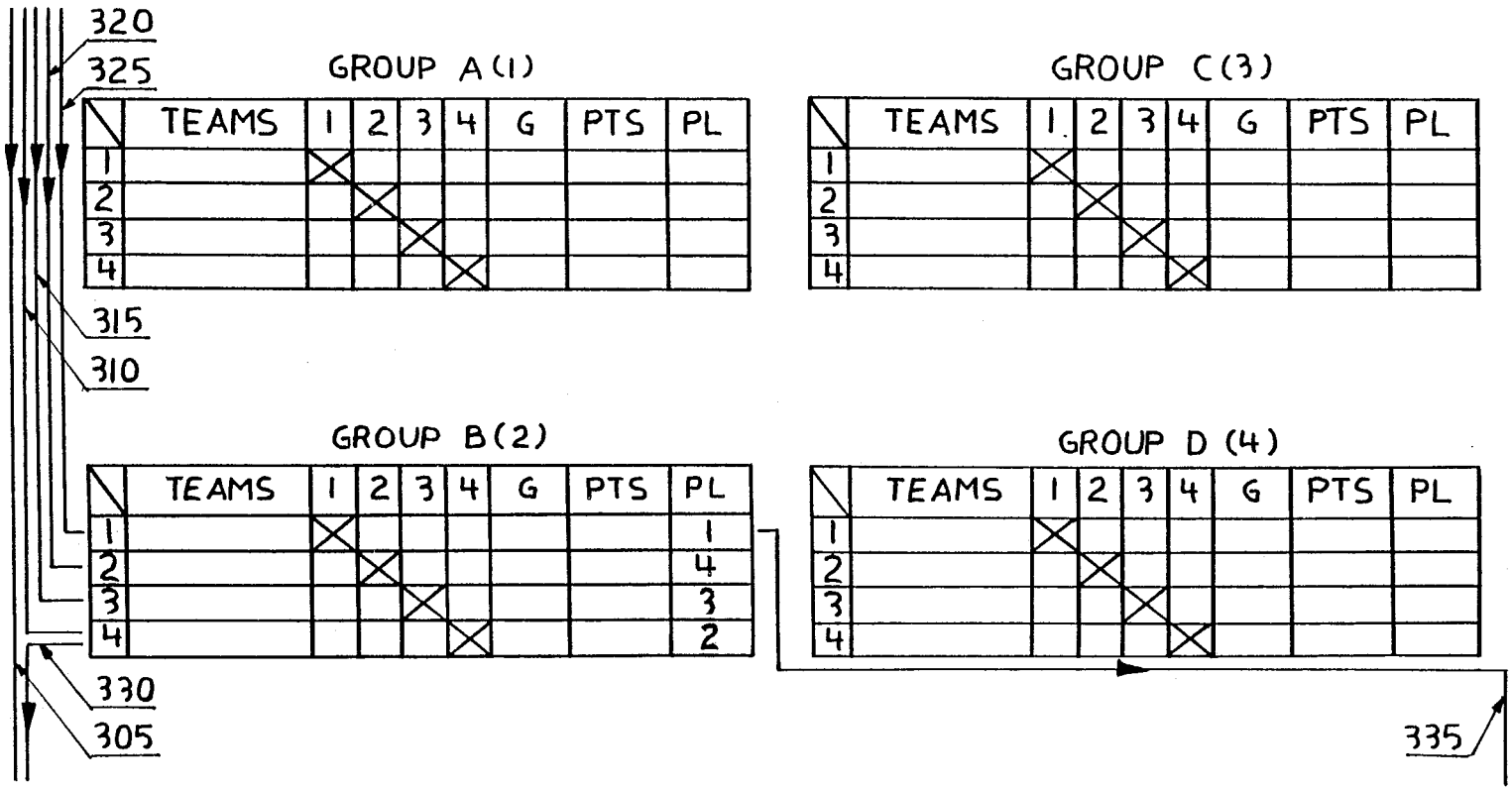
Figure 9D:
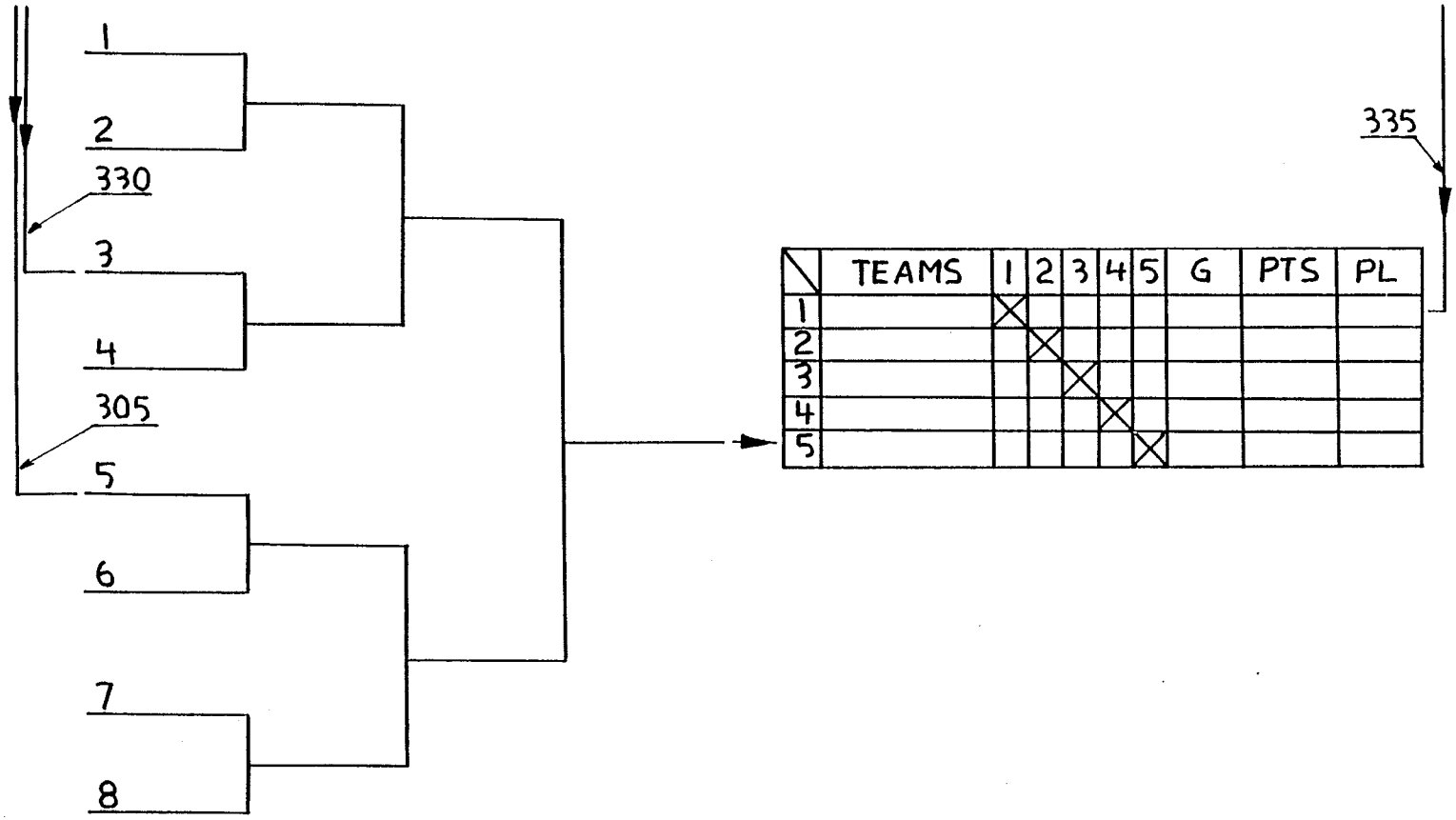
Figure 10A:
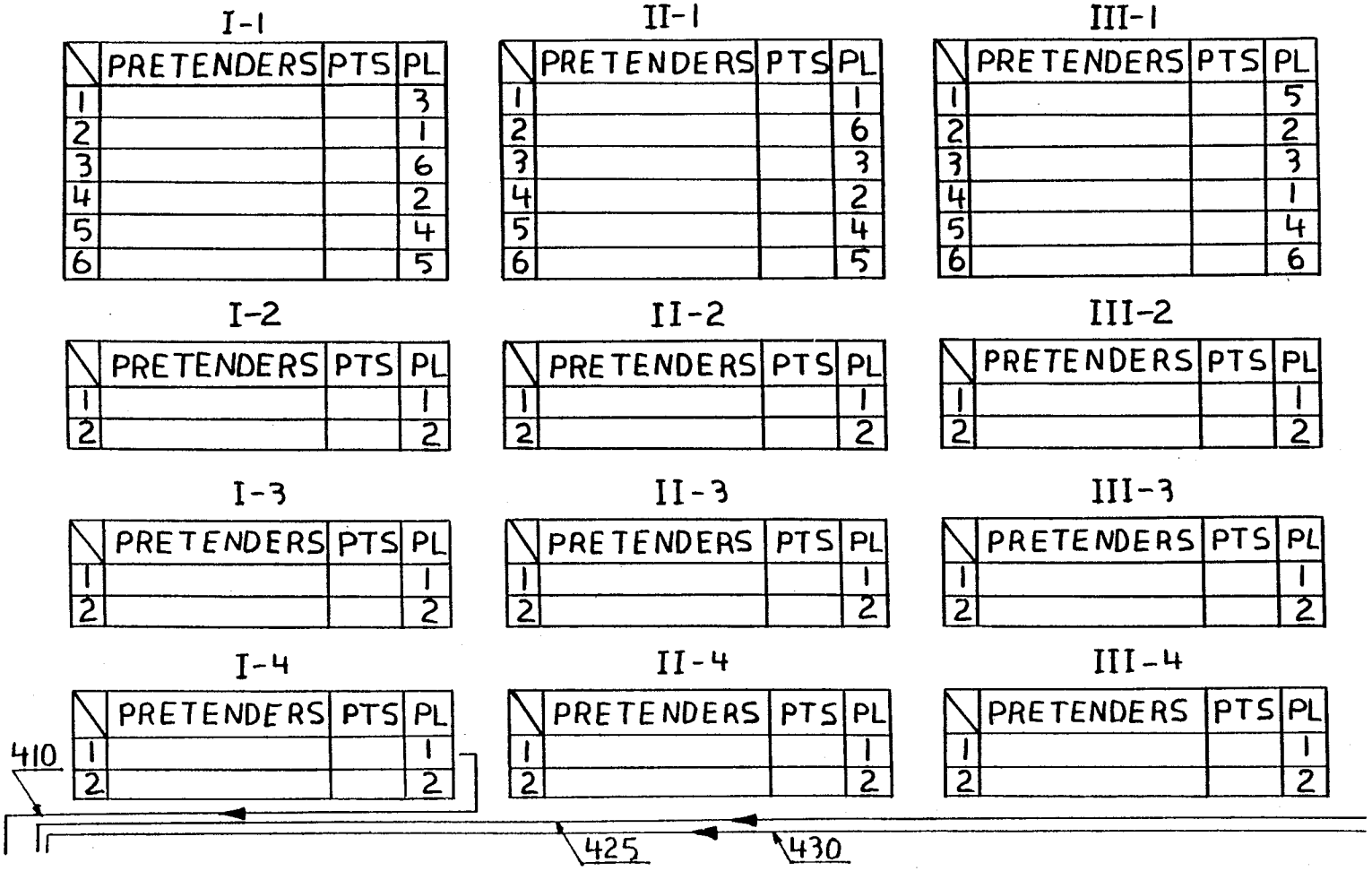
Figure 10B:
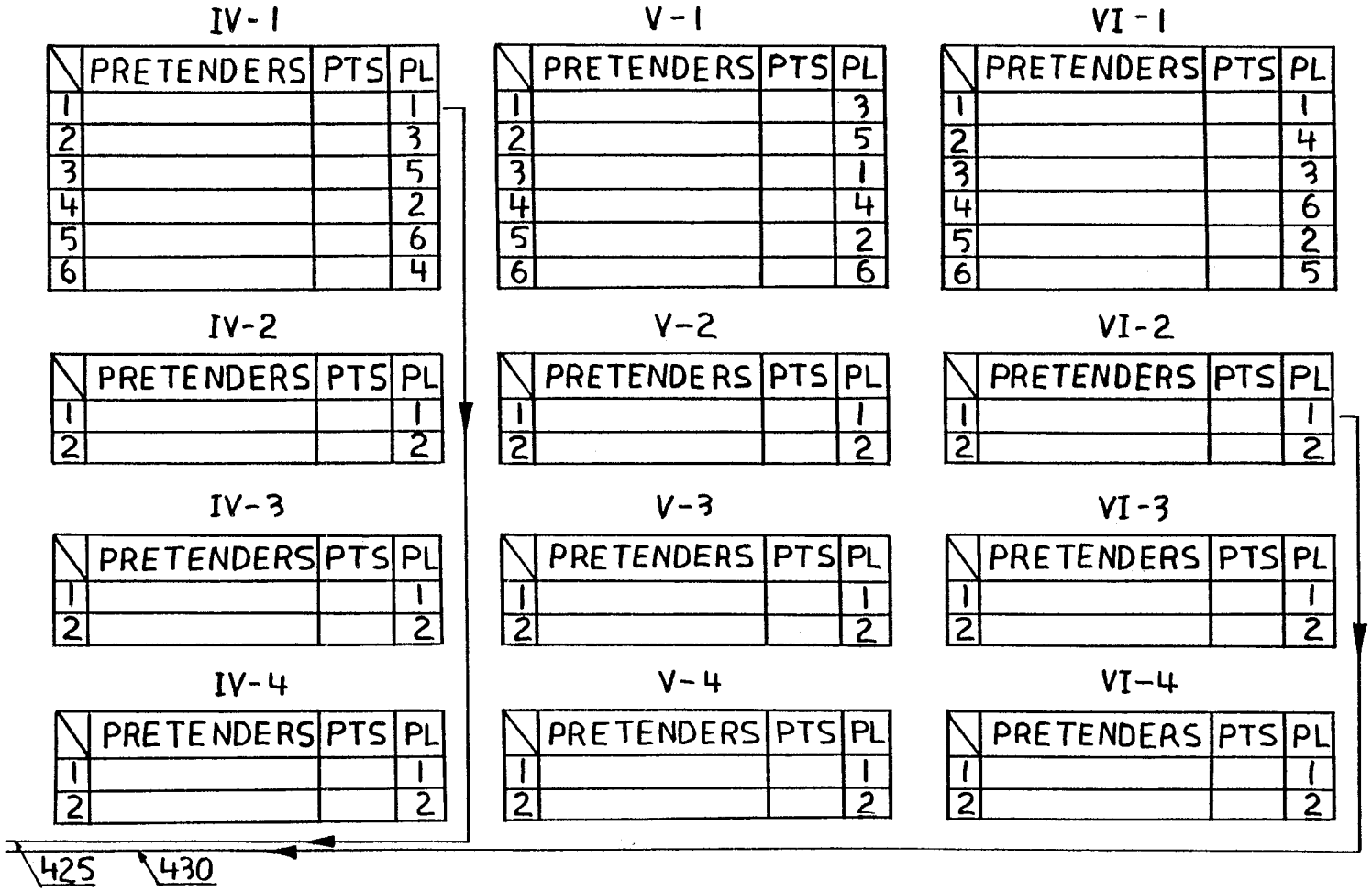
Figure 10C:
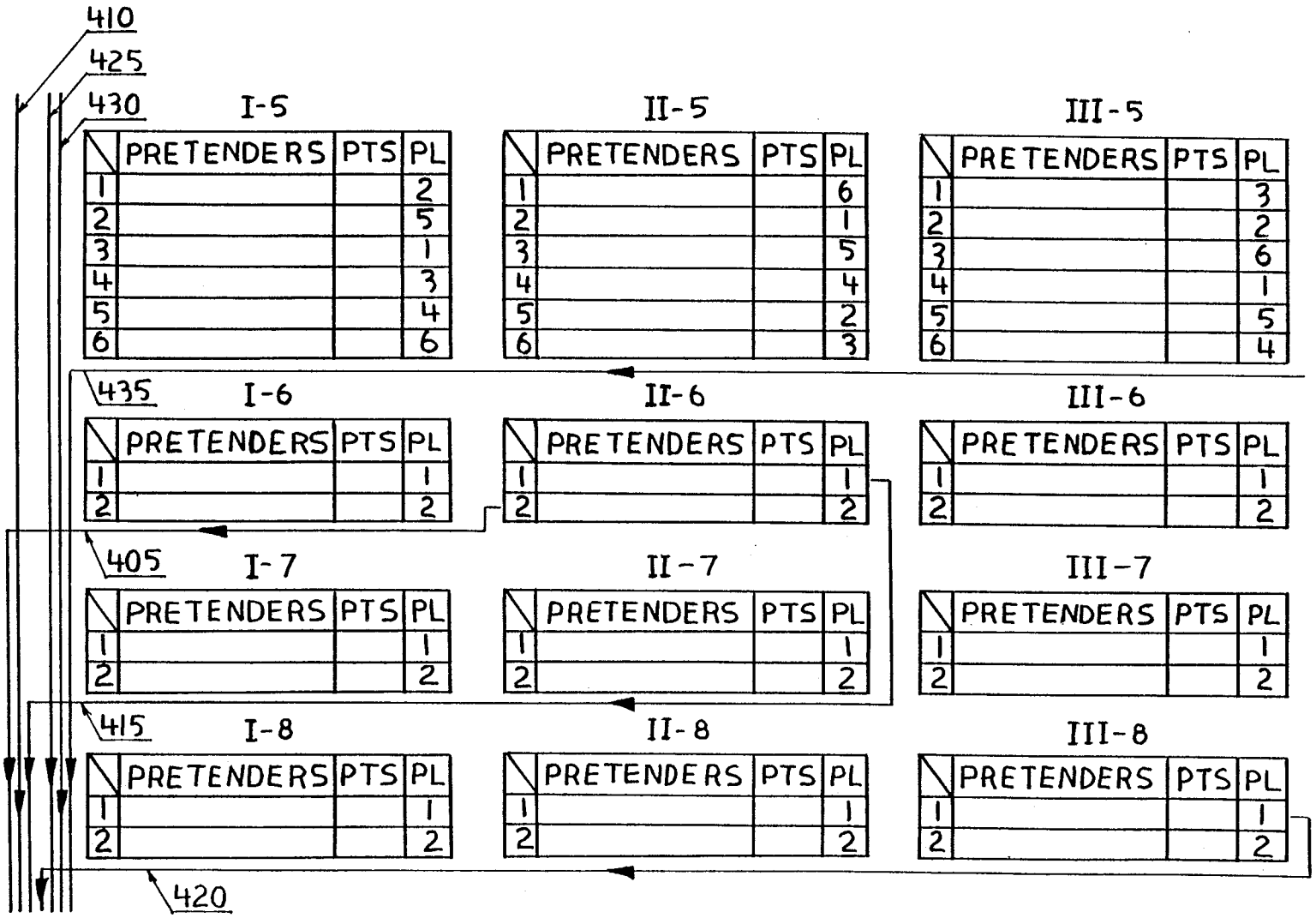
Figure 10D:
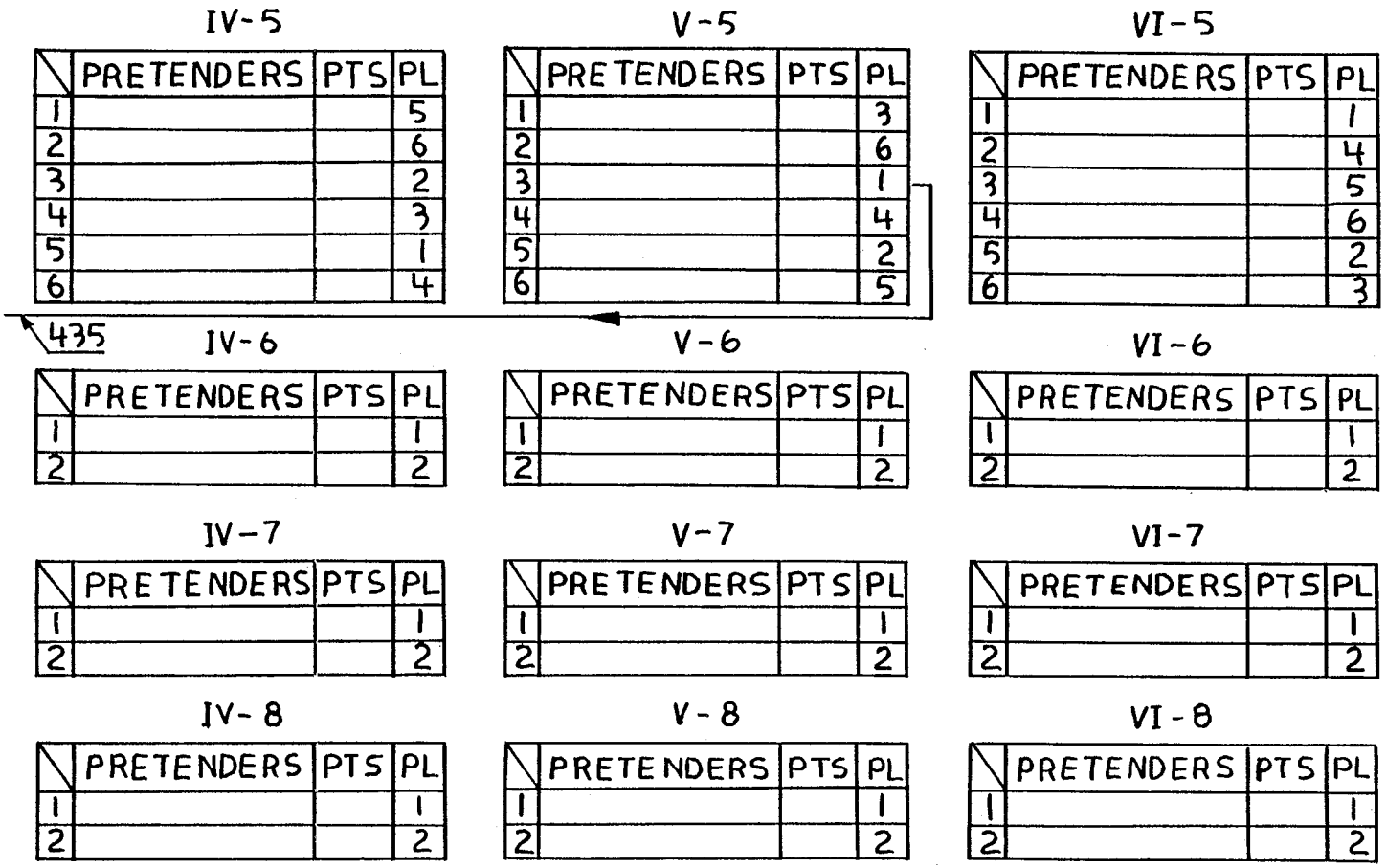
Figure 10E:
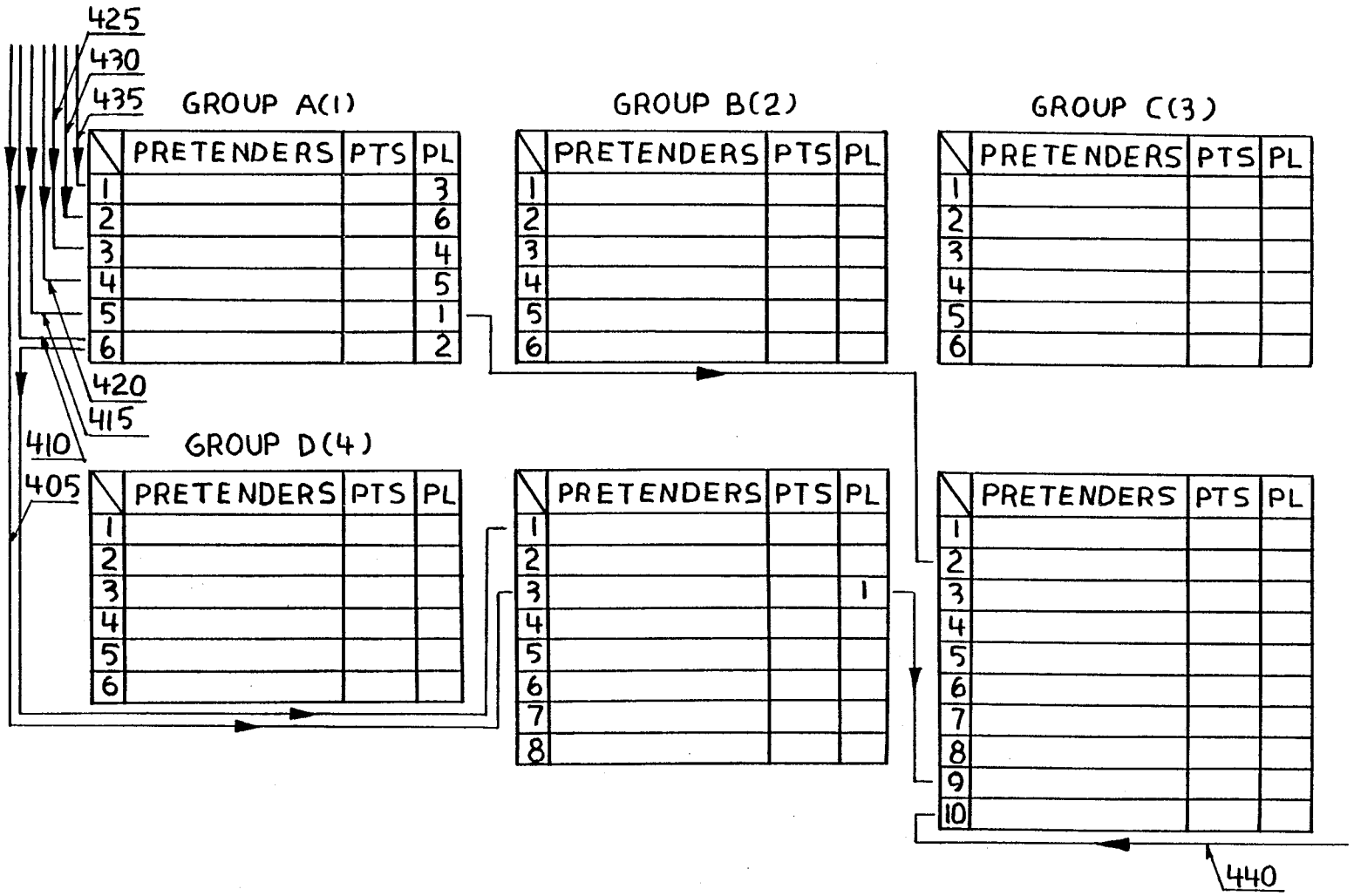
Figure 10F:
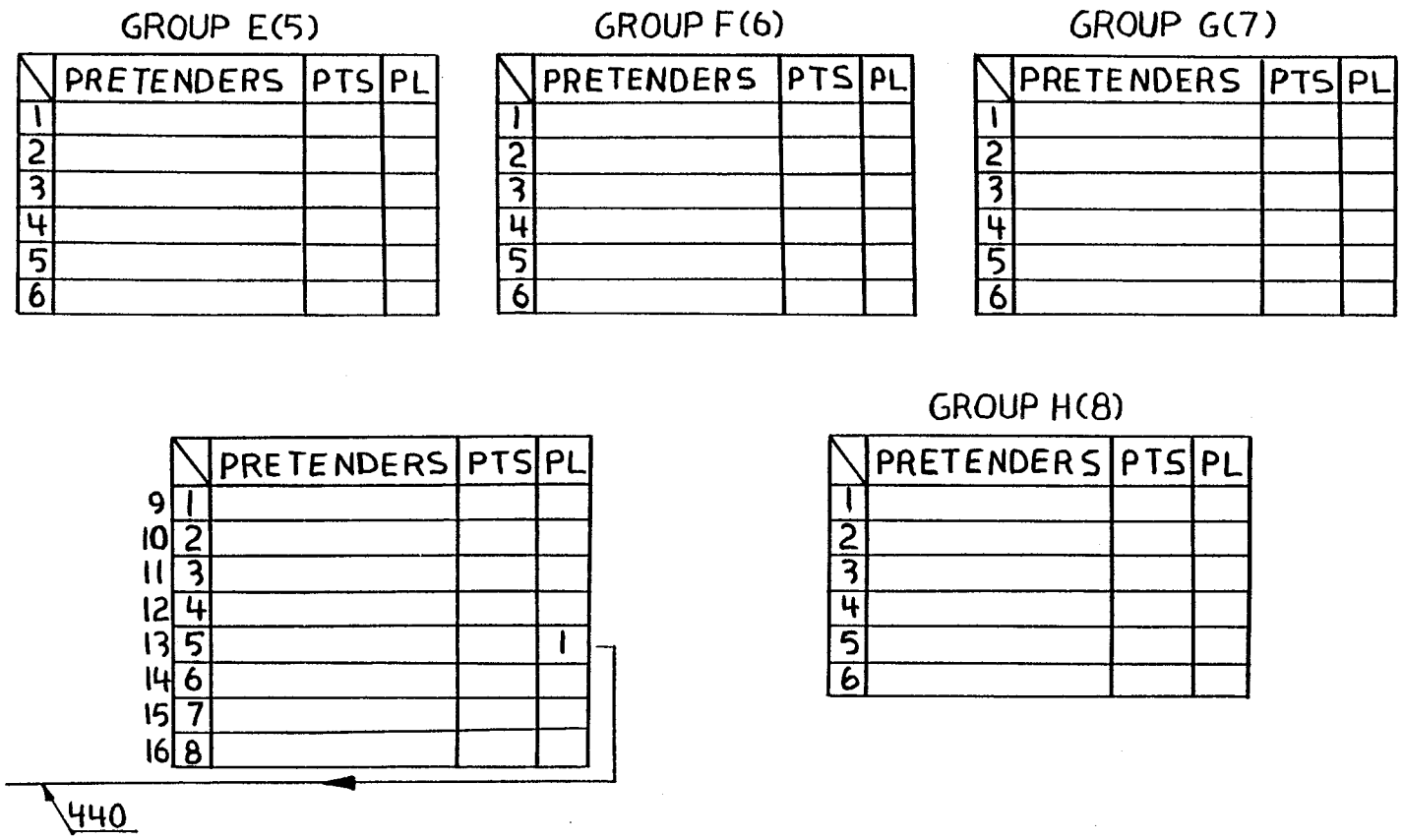
Figure 11A:
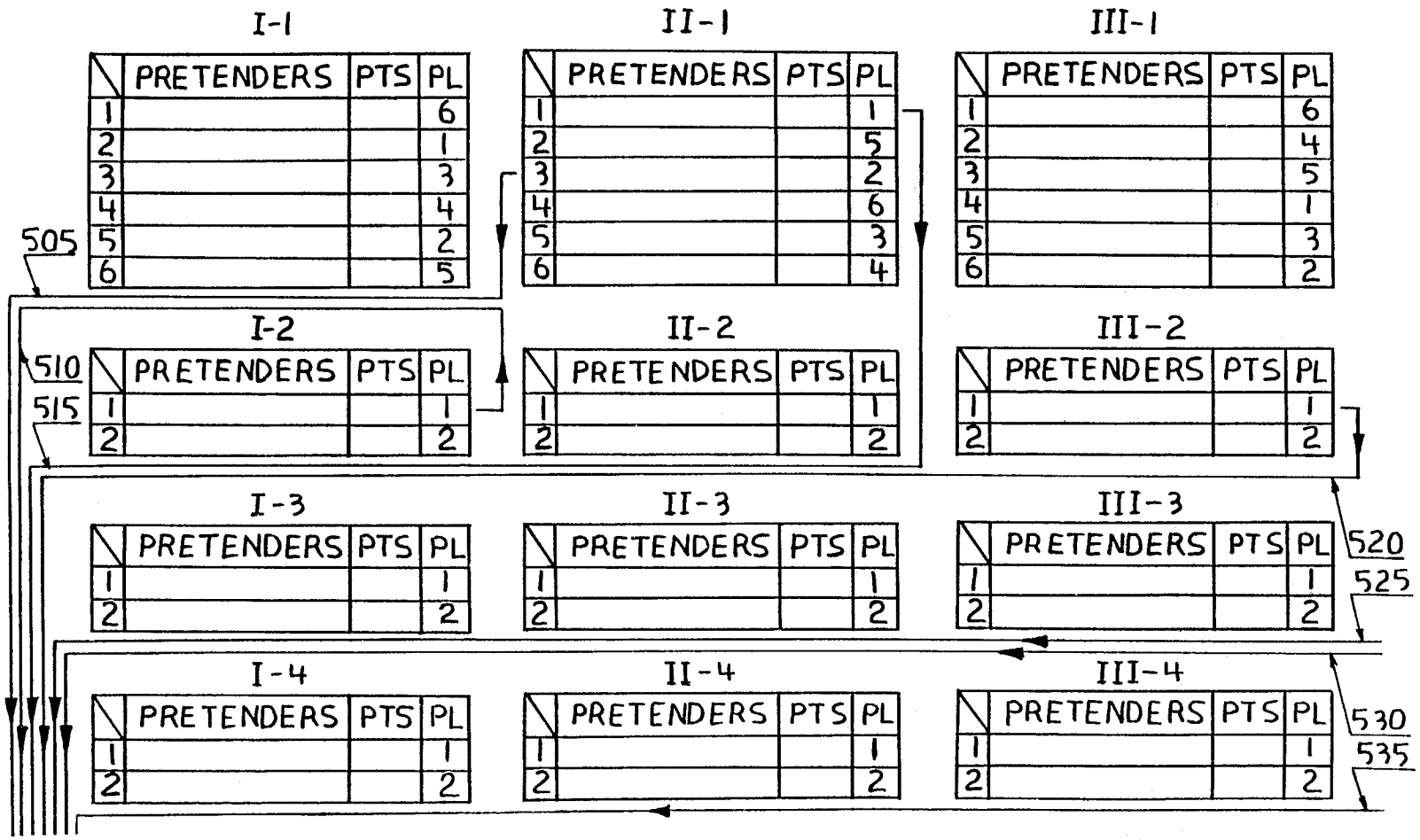
Figure 11B:
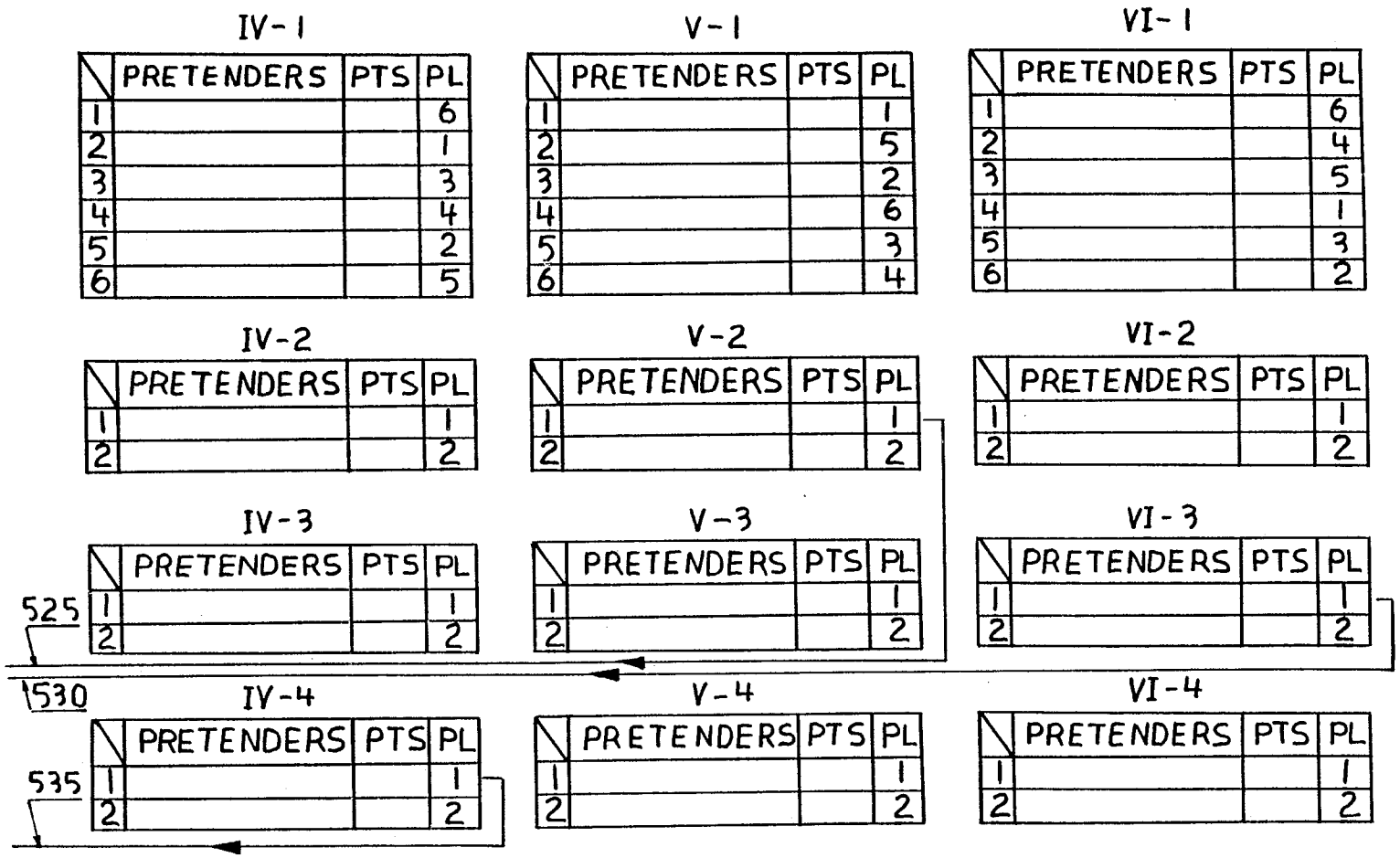
Figure 11C:
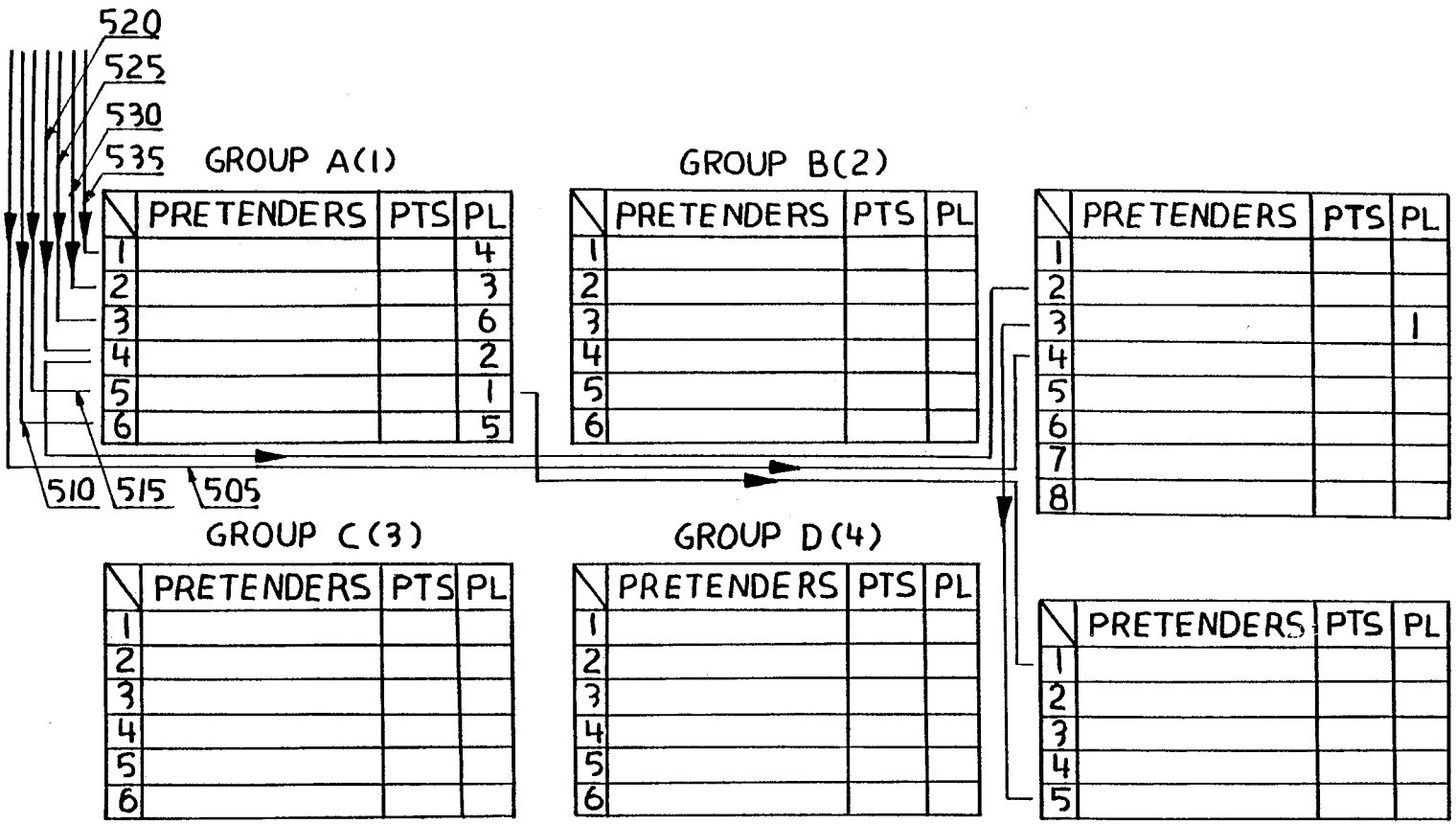

The positioning of competitions within the additional tournament is determined based on the criteria set forth in FIG. 12. As shown therein, in sporting game competitions wherein each zone contains 8 lower stage groups, the final group positions for first place finishers in the intermediate groups are numbered from 1 to 4 and from 6 to 9 (see FIGS. 7G and 7H). The first place finisher from intermediate group E is randomly placed in position 3 (Final Group A). As shown in FIG. 12, if the second place finisher from intermediate group E is placed in an additional tournament position from 9 to 12, then the second place finisher from lower stage EU-2 is placed in an additional position from 13 to 16. Conversely, if the second place finisher from intermediate group E is placed in position 13 to 16, then the second place finisher from lower stage EU-2 is placed in position 9 to 12. Thus, as shown in FIG. 7H, since the first place finisher from intermediate group E has been placed in position 3, the second place finisher from Group EU-2 has been placed in additional tournament position 10 and the second place finisher from intermediate group E has been placed in position 13.

The winner from the Additional Tournament (Section II) is placed in position 5 of Final Group B (overall position 10). Thus, if the second place finisher from lower stage group EU-2 or intermediate group E qualifies for a final group by winning this Additional Tournament, that competitor will be placed in the opposite final group from the final group containing the first place finisher against whom it has already competed.

FIG. 8 shows a score-table for a sporting game competition. The competitors are divided into four zones and each zone contains eight lower stage groups. The lower stage groups in Zone IV are each divided into subgroups; Lower Stage Groups IV-1 and IV-5 are each divided into three subgroups while the remaining six lower stage groups in Zone IV are each divided into two subgroups.

The first place finishers in Lower Stage Groups I-4, II-5, III-2, and IV-5 are each shown advancing to Intermediate Group E by lead lines 215, 210, 220 and 225, respectively. The first place finisher in Intermediate Group is shown advancing to Final Group A by lead line 235 (position 2). Thus, the second place finishers in Lower Stage Group III-2 and Intermediate Group A are shown advancing to Additional Tournament (Section II) by lead lines 205 and 230, respectively, and are placed in positions 10 and 13, respectively.

FIG. 9 shows a second score-table for a sporting game competition, the competitors being divided into four zones and each zone being divided into four lower stage groups. The first place finishers in Lower Stage Groups I-3, II-3, III-2 and IV-1 are shown advancing to Intermediate Group B by lead lines 315, 310, 320 and 325, respectively. The first place finisher in Intermediate Group B advances to the sole Final Group (lead line 335). The second place finishers from Lower Stage Group III-2 and Intermediate Group B advance to the sole Additional Tournament by lead lines 305 and 330, respectively, and are placed in positions 5 and 3, respectively.

FIG. 10 shows a score-table for sporting non-game competitions and non-sporting competitions. The competitors (pretenders) are divided into six zones and each zone contains eight lower stage groups. The first place finishers from Lower Stage Groups I-4, II-6, III-8, IV-1, V-5, and VI-8 are shown advancing to Intermediate Group A. The first place finisher in Intermediate Group A is shown advancing to the sole Final Group (position 2). The second place finishers in Lower Stage Group II-6 and Intermediate Group A are shown advancing to Additional Tournament (Section I). The positioning of competitors within the additional tournaments is not critical for the sporting non-game competitions and non-sporting competitions of FIG. 10 (For details, see FIG. 12).

FIG. 11 shows a second score-table for sporting non-game competitions and non-sporting competitions. The competitors are divided into six zones and each zone contains four lower stage groups. The first place finishers in Lower Stage Groups I-2, II-1, III-2, IV-4, V-2 and VI-3 are shown advancing to Intermediate Group A. The first place finisher in Intermediate Group A is shown advancing to the sole Final Group. Thus, the second place finishers in Lower Stage Group II-1 and Intermediate Group A advance to the sole Additional Tournament.

Having thus described the invention, I claim:

1. A method for conducting a competition which comprises:

(a) means for dividing competitors into a plurality of zones, wherein each zone comprises four or eight lower stage groups, and wherein each lower stage group comprises a plurality of competitors;

(b) means for collecting a first place finisher from one lower stage group in each of said zones to form an intermediate group, whereby the first place finishers in each of said lower stage groups are part of an intermediate group, and wherein the number of intermediate groups is equal to the number of lower stage groups;

(c) means for collecting four first place finishers from said intermediate groups to form a final group of competitors, wherein the number of final groups is equal to one quarter the number of lower stage groups in each zone;

(d) means for collecting second place finishers from:

(i) each of the lower stage groups in which one of the final group competitors competed and (ii) each of the intermediate stage groups in which one of the final group competitors competed, to form one or two additional tournament groupings, each additional tournament grouping comprising eight competitors, wherein the number of additional tournament groupings is equal to one fourth the number of lower stage groups in each zone, and wherein the second place finishers from the lower stage group and from the intermediate stage group in which a final group competitor competed are separated so as to be matched against each other in said additional tournament grouping no earlier than the final round therein;

(e) means for adding the first place finisher from each of said one or two additional tournament groupings to a final group of competitors, such that each final group of competitors comprises five competitors; and (f) displaying the winner from said final group or groups of competitors.

2. The method of claim 1, wherein said competition is an athletic event selected from the group consisting of tennis, basketball, soccer, wrestling, baseball, fencing, gymnastics, and hockey.

3. The method of claim 1, wherein said competition is a non-athletic event selected from the group consisting of a beauty contest, quiz show and spelling bee.

4. The method of claim 1, wherein said winner from said final group is displayed on an electronic scoreboard.

5. The method of claim 1, wherein said competition is a soccer competition and wherein:

(a) said first place finisher in each of said lower stage groups is determined based on the results of two competitions between each of the competitors within said lower stage group;

(b) said first place finisher in each of said intermediate groups is determined based on the results of two competitions between each of the competitors within said intermediate group;

(c) said first place finisher from each of said additional tournament grouping is determined based on a series of single elimination competitions between the competitors in said additional tournament grouping, each of the elimination rounds being based on two competitions between a pair of competitors; and (d) said winner from said final group of competitors is determined based on a round-robin series of competitions between the five competitors in each of said final groups of competitors.

6. The method of claim 5, further comprising means for scoring said competitions.

7. The method of claim 6, wherein said scoring means comprises:

(a) scoring 2.5 points to a competitor that wins a competition in regulation time;

(b) scoring 1.5 points to a competitor that wins a competition in an overtime period;

(c) scoring 1.0 points to a competitor that wins a competition after the expiration of said overtime period; and (d) scoring zero points to a losing competitor.

8. The method of claim 1, further comprising:

(g) means for collecting the first place finishers from each of the lower stage groups within a zone to compete for a zone championship; and (h) displaying the zone champion; whereby the competitors compete within a lower stage group to simultaneously qualify for a zone champion and the competition of steps (a) to (f).

9. The method of claim 8, wherein the winner of the competition of steps (a) to (f) becomes a world champion.

10. The method of claim 1, further comprising:

(g) means for randomly dividing six teams into two groups, each group comprising three teams, wherein each of said teams comprises players who are from countries where the same language is the primary spoken language, and wherein the teams within each group compete in a single round-robin tournament;

(h) means for pairing the first place finishers and for pairing the second place finishers from each of said groups; and (i) displaying the positional finishes of said four paired teams, wherein the winner of said pairing of first place finishers is the overall first place finisher, the loser of said pairing of first place finishers is the overall second place finisher, the winner of said pairing of second place finishers in the overall third place finisher, and the loser of said pairing of second place finishers is the overall fourth place finisher.

11. The method of claim 10, wherein one of said teams comprises players from countries wherein the primary spoken language is selected from the group consisting of English, German, Italian, French, Portuguese and Spanish.

12. A method for conducting a competition comprising:

(a) means for randomly dividing six teams into two groups, each group comprising three teams, wherein each of said teams comprises players who are from countries where the same language is the primary spoken language, and wherein the teams within each group compete in a single round-robin tournament;

(b) means for pairing the first place finishers and for pairing the second place finishers from each of said groups; and (c) displaying the positional finishes of said four paired teams, wherein the winner of said pairing of first place finishers is the overall first place finisher, the loser of said pairing of first place finishers is the overall second place finisher, the winner of said pairing of second place finishers in the overall third place finisher, and the loser of said pairing of second place finishers is the overall fourth place finisher.

* * * * *